US006177660B1

(12) United States Patent
Usui et al.

(10) Patent No.: US 6,177,660 B1
(45) Date of Patent: Jan. 23, 2001

(54) MAGNET TYPE HEATER

(75) Inventors: Masayoshi Usui; Hiroshi Inoue; Kazunori Takikawa, all of Numazu (JP)

(73) Assignee: Usui Kokusai Sangyo Kaisha Limited (JP)

( * ) Notice: Under 35 U.S.C. 154(b), the term of this patent shall be extended for 0 days.

(21) Appl. No.: 09/309,225

(22) Filed: May 10, 1999

(30) Foreign Application Priority Data

May 12, 1998 (JP) ..... 10-146552

(51) Int. Cl.[7] ..... H05B 6/10
(52) U.S. Cl. ..... 219/631; 219/618
(58) Field of Search ..... 219/631, 630, 219/672, 628, 629

(56) References Cited

U.S. PATENT DOCUMENTS 4,421,967 * 12/1983 Birgel et al. ..... 219/631
4,511,777 * 4/1985 Gerard ..... 219/631
4,600,821 * 7/1986 Fichtner et al. ..... 219/631
4,614,853 * 9/1986 Gerard et al. ..... 219/631
4,629,844 * 12/1986 Griffith et al. ..... 219/618
5,012,060 * 4/1991 Gerard et al. ..... 219/631
5,773,798 * 6/1998 Fukumura ..... 219/631
5,914,065 * 6/1999 Alavi ..... 219/631

* cited by examiner

*Primary Examiner*—Teresa Walberg
*Assistant Examiner*—Jeffrey Pwu
(74) *Attorney, Agent, or Firm*—Anthony J. Casella; Gerald E. Hespos; Michael J. Porco

(57) ABSTRACT

An auxiliary heater is provided for heating a fluid flowing through a pipe. The heater includes a conductor mounted in proximity to the pipe. A magnet is opposed to the conductor with a small gap therebetween. Relative rotation is generated between the conductor and the magnet. The rotation causes the conductor to be heater by slip heat generation. The heated conductor, in turn, heats the fluid in the pipe.

3 Claims, 18 Drawing Sheets

MAGNET TYPE HEATER

BACKGROUND OF THE INVENTION

1. Field of the Invention

The present invention relates to a magnet type heater which is used for promoting starting performance of an engine mainly for various kinds of vehicles such as an automobile with a power source of a diesel engine or a gasoline engine particularly in cold time or extremely cold time and as auxiliary heating means of a fluid in a pipe such as cooling water of an engine used for various kinds of vehicles including an electric automobile or for heating a cabin in a ship, which is used for preheating or rapid temperature elevation (shortening of warming up time) of cooling water for a generator driven by an engine and an engine of a welder, a compressor or a construction machine and which can be utilized for temperature elevation of a catalyst apparatus of emission gas of an engine or fuel gas for a fuel cell.

2. Description of the Prior Arts

There has been known a viscous type heater as a heat source of auxiliary heating for a vehicle such as an automobile which is utilized in heating cooling water of an engine in starting operation in a cold district (refer to JP-A-2-246823, JP-A-4-11716U, JP-A-9-254637, JP-A-9-66729, JP-A-9-323530 or the like).

A viscous type heater is of a type in which viscous fluid such as silicone oil is made to generate heat by shearing, the generated heat is exchanged by circulating water circulating in a water jacket and used as a heat source for heating. As a structure thereof, for example, a heat generating chamber is formed in a housing, a water jacket is formed at an outer region of the heat generating chamber, a drive shaft is rotatably supported by the housing via a bearing apparatus, a rotor rotatable in the heat generating chamber is fixed to the drive shaft, a viscous fluid such as silicone oil is enclosed in a gap between a wall face of the heat generating chamber and the rotor, circulating water is taken into the water jacket from a water intake port and is circulated to deliver from a water delivery port to an outside heating circuit.

According to the viscous type heater integrated to a heating apparatus of a vehicle, when the drive shaft is driven by an engine, the rotor is rotated in the heat generating chamber and accordingly, the viscous fluid generates heat at the gap between the wall face of the heat generating chamber and an outer face of the rotor by shearing, the generated heat is exchanged by the circulating water in the water jacket and the heated circulating water is used for heating the vehicle as cooling water of the engine.

Further, as a method of purifying to reduce NOx in emission gas of an engine, there is a method of heating the emission gas by heating a catalyst installed in a pipe by an electric heater (EHC) arranged to be proximate to the catalyst.

The viscous type heater is featured in that downsizing and cost reduction can be realized by a simple structure, high reliability and safety can be ensured by a noncontact type mechanism having no wear and when water temperature is elevated and an auxiliary heater is dispensed with, the operation is automatically stopped by temperature control and accordingly, wasteful energy is not used. However, according to silicone oil used as a viscous fluid, the viscosity is gradually reduced and the shear resistance is reduced with an increase in the rotational number of the rotor and accordingly, temperature attained by heat generation of silicone oil is limited to about 240° C. and accordingly, there is a difficulty in which temperature of the circulating water cannot be elevated so high, some time period is required until the silicone oil is agitated in starting operation and accordingly, rapid heating effect cannot be achieved when the engine is cold. Accordingly, in the case of a cold district specified vehicle mounted with a diesel engine, such a viscous type heater cannot be regarded as sufficient in view of the effectiveness and there has been desired an auxiliary heater capable of heating a fluid in a pipe to high temperature in a shorter period of time and more efficiently.

Further, according to the method in which the catalyst is heated and activated by the electric heater (EHC), there is a difficulty in which some time is required in elevating the catalyst to a catalyst activation temperature, for example, in the case of a diesel engine, emission gas temperature is lowered by high function formation, and particularly, in idling, the catalyst temperature becomes as low as 100° C. and the purification capability of the NOx catalyst cannot sufficiently be achieved.

SUMMARY OF THE INVENTION

The present invention has been carried out in view of the problem of the above-described viscous type heater and the conventional problem in which the purifying function of the NOx catalyst of emission gas of an engine is low. It is an object of the invention to provide a magnet type heater capable of elevating temperature of a fluid in a pipe to higher temperature and in a shorter period of time than the viscous type heater, excellent in heat resistance performance and effective in reducing NOx, HC (hydrocarbon) or the like included in emission gas of a gasoline engine or a diesel engine and which can be used for elevating temperature of fuel gas of hydrogen or the like for a fuel cell.

A magnet type heater according to the invention is of a type in which magnetic paths formed between a magnet and a conductor are sheared by which slip heat generation generated on the side of the conductor is thermally exchanged by a fluid in a pipe and according to the gist of a first aspect of the invention, there is provided a magnet type heater which is of a system in which a magnet and a conductor are arranged to be opposed to each other with a very small gap therebetween and a fluid in a pipe is heated by slip heat generation generated in the conductor by relatively rotating the magnet and the conductor, the magnet type heater comprising a structure in which a permanent magnet arranged to be opposed to the conductor with a very small gap therebetween is installed to fix at an inner portion of a cylinder type housing supported rotatably by the pipe of the fluid via a bearing device to surround the conductor fitted to an outer periphery of the pipe of the fluid and the fluid in the pipe is heated by the slip heat generation generated in the conductor by rotating the cylinder type housing.

According to a second aspect of the invention, the conductor is constituted by a pipe having an inner diameter the same as an inner diameter of the pipe of the fluid, a permanent magnet arranged to be opposed to the conductor with a very small gap therebetween is installed to fix at an inner portion of a cylinder type housing supported rotatably by an outer periphery of the conductor via a bearing device and the fluid in the pipe is heated by the slip heat generation generated in the conductor by rotating the cylinder type housing. Further, the conductor according to the second aspect of the invention is connected to portions of the pipe of the fluid by joints or installed with heat radiating fins on an inner peripheral face of the conductor.

According to a third aspect of the invention, the pipe of the fluid is made of a conductor, a pair of permanent magnets in a circular disk shape rotatably supported on planes in parallel with a pipe shaft direction on a center line in a radius direction of the pipe on external sides of the pipe of the fluid made of the conductor, are arranged opposedly thereto with very small gaps therebetween and the fluid in the pipe is heated by the slip heat generation generated in the pipe of the fluid made of the conductor by rotating the permanent magnets in the circular disk shape. Further, the section of the pipe arranged opposedly to the permanent magnets in the circular disk shape of the pipe of the fluid made of the conductor according to the third aspect of the invention, is formed in a flattened shape such as an oval shape or an elliptic shape, further, the pipe portion arranged opposedly to the permanent magnets in the circular disk shape of the pipe of the fluid made of the conductor is constituted by a plurality of pipes each having a section in a flattened shape.

According to a fourth aspect of the invention, the pipe of the fluid is made of a resin, a pair of permanent magnets in a circular disk shape supported rotatably on planes in parallel with a pipe shaft direction on a center line in a radius direction of the pipe on external sides of the pipe of the fluid made of the conductor, are arranged to be opposed thereto with small gaps therebetween and a pipe made of the conductor is internally fitted fixedly to an inner portion of the pipe of the fluid opposed to the permanent magnets in the circular disk shape and the fluid in the pipe is heated by the slip heat generation generated in the pipe made of the conductor by rotating the permanent magnets in the circular disk shape.

According to a fifth aspect of the invention, the pipe of the fluid is made of a conductor, a permanent magnet in a cylindrical shape arranged opposedly to an outer periphery of the pipe of the fluid made of the conductor with a small gap therebetween, is rotatably supported via bearing devices, a heat exchange core is installed at an inner portion of the pipe of the fluid arranged to be opposed to the permanent magnet in the cylindrical shape and the fluid flowing in the heat exchange core is heated by slip heat generation generated in the pipe of the fluid made of the conductor by rotating the permanent magnet in the cylindrical shape.

According to a sixth aspect of the invention, a heat exchange core made of a conductor is arranged in the pipe of the fluid, a permanent magnet having communication holes arranged to be opposed to the heat exchange core made of the conductor with a small gap therebetween, is supported rotatably in the pipe of the fluid via a bearing device and the fluid flowing in the heat exchange core is heated by slip heat generation generated in the heat exchange core made of the conductor by rotating the permanent magnet having the communication holes.

According to a seventh aspect of the invention, heat exchange cores made of a conductor are arranged in tandem in the pipe of the fluid, permanent magnets each having communication holes arranged to be opposed to the respective heat exchange cores made of the conductor are supported rotatably in the pipe path of the fluid via bearing devices between the heat exchange cores made of the conductor on an upstream side and a downstream side and the fluid flowing in the upstream side and the downstream side of the heat exchange cores is heated by slip heat generation generated in the upstream side and the downstream side of the heat exchange cores made of the conductor by rotating the permanent magnets each having the communication holes.

According to an eighth aspect of the invention, a hollow heat exchange core made of a conductor is arranged in the pipe of the fluid, a permanent magnet in a cylindrical shape arranged to be opposed to the hollow heat exchange core made of the conductor with a small gap therebetween is supported rotatably in the pipe of the fluid via a bearing device and the fluid flowing in the hollow heat exchange core made of the conductor is heated by the slip heat generation generated in the hollow heat exchange core made of the conductor by rotating the permanent magnet in the cylindrical shape.

According to a ninth aspect of the invention, a hollow heat exchange core is supported rotatably in the pipe of the fluid via a bearing device, a permanent magnet in a cylindrical shape arranged opposedly to the hollow heat exchange core made of the conductor with a small gap therebetween is rotatably supported in the pipe of the fluid via a bearing device and by relatively rotating the permanent magnet in the cylindrical shape and the hollow heat exchange core made of the conductor or by relatively rotating the permanent magnet in the cylindrical shape and the hollow heat exchange core made of the conductor respectively in directions opposed to each other, the fluid flowing in the hollow heat exchange core made of the conductor is heated by the slip heat generation generated in the hollow heat exchange core made of the conductor. Further, the heat exchange core according to each of the fifth through the ninth aspects of the invention is constituted by a honeycomb core member. Further, a catalyst is carried by the honeycomb member and a catalyst reaction is carried out by heating a fluid to be treated flowing in the honeycomb core member.

Further, a hysteresis member or a hysteresis member installed with an eddy current member on a side of the magnet can be used as a conductor.

The "slip heat generation" according to the invention signifies that when a conductor is moved (rotated) in a direction of cutting a magnetic field in the magnetic field generated by the magnet, eddy current is generated in the conductor and heat is generated by electric resistance in the conductor of the eddy current.

That is, the invention is featured in that two members of a permanent magnet (made of ferrite, rare earth metals or the like) and a material having large magnetic hysteresis (hereinafter, referred to as "hysteresis member") or a conductor (heat generating member) of an eddy current member or the like are arranged to be opposed to each other with a small gap therebetween and the slip heat generation generated on the side of the conductor by shearing magnetic paths by rotating relatively the magnet and the conductor is utilized and heat is generated at temperature of 200 through 600° C. in several seconds through several tens seconds by using an eddy current member or a hysteresis member for the conductor. Further, although the gap is not particularly limited, the gap is normally about 0.3 through 1.0 mm.

As a heat exchange system according to the invention, there can be used a system in which a fluid in a pipe is directly or indirectly brought into contact with a conductor constituting a heat generating member. As a system of carrying out heat exchange by bringing a fluid in a pipe into direct contact with a conductor, there can be used a system in which a surface of the conductor is exposed in the pipe of the fluid in the pipe by installing window holes in the pipe of the fluid in the pipe or a system of bringing the fluid in contact with heat radiating fins. Further, as a system of carrying out heat exchange by bringing the fluid in the pipe into indirect contact with the conductor, there can be used a system of carrying out heat exchange via a wall of the pipe of the fluid in the pipe or by installing a heat exchange core.

Further, as a system of driving to rotate a permanent magnet and a heat exchange core according to the invention, for example, there can be used a system of rotating them by using a rotor or a pulley or a gear driven to rotate by motor drive or engine drive. Particularly, in the case of the motor drive system, it is possible to set a heat generating amount as desired by controlling the rotational speed or to make OFF a drive motor at a time point where a predetermined temperature is reached or to rotate reversely for rapid heating.

Further, as ON/OFF controlling means of the magnet type heater, there can be used, for example, a system in which temperature of the fluid in the pipe is measured by using a temperature sensor and rotational drive of a permanent magnet or a heat exchange core is stopped at a time point where predetermined temperature is reached.

According to the invention, the conductor generates heat by relative rotation between the magnet and the conductor and the amount of heat generation is not comparable to that of the viscous type heater and the heat generation amount can continue maintaining a high value. Further, by using an eddy current member or a hysteresis member for the conductor, heat can be generated at temperature of 200 through 600° C. in several seconds through several tens seconds and accordingly, when NOx of emission gas is to be reduced by making a honeycomb core member carry a catalyst, the temperature of the catalyst can be elevated to temperature of activating the catalyst in a short period of time.

BRIEF DESCRIPTION OF THE DRAWINGS

FIG. 5A is a perspective view showing a ribbon type fin and FIG. 5B is a perspective view showing a cross type fin, respectively;

FIG. 10A is a vertically cut side view and FIG. 10B is a sectional view taken along a line X—X of FIG. 10A;

FIG. 11A is a vertically cut side view and FIG. 11B is a sectional view taken along a line XI—XI of FIG. 11A;

FIG. 12A is a vertically cut side view and FIG. 12B is a sectional view taken along a line XII—XII of FIG. 12A;

DETAILED DESCRIPTION OF PREFERRED EMBODIMENTS

Figure 1:
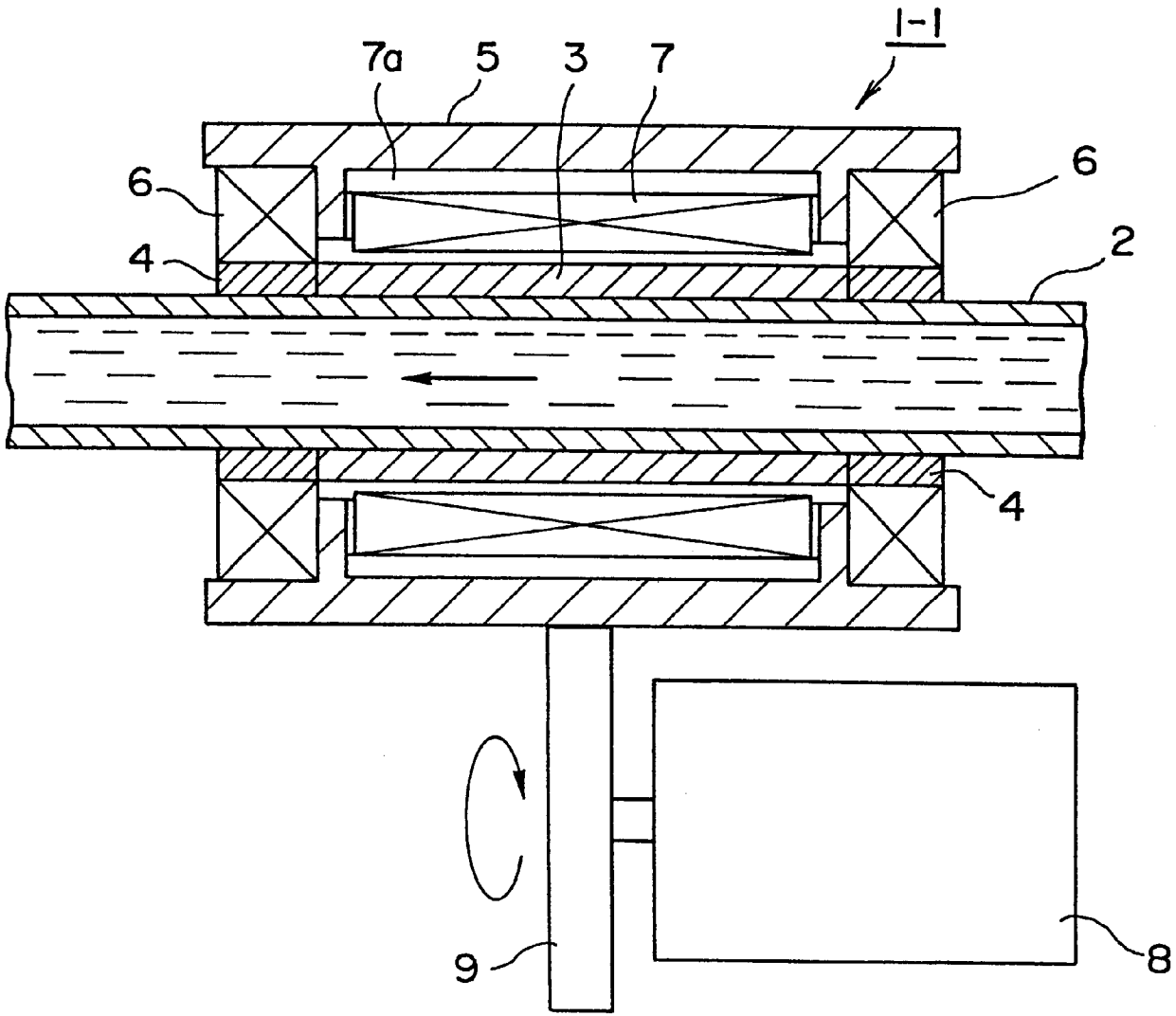
FIG. 1 is a vertically cut side view showing a first embodiment of a magnet type heater according to the invention.

An explanation will be given of a magnet type heater according to the invention in reference to the attached drawings as follows. Notation 1-1, 1-2, 1-3, 1-4, 1-5, 1-6, 1-7, 1-8, 1-9, 1-10, 1-11, 1-12, 1-13 1-14, or MH designates a magnet type heater, numeral 2 designates a fluid pipe, numeral 3 designates a conductor pipe, notation 3-1 designates an eddy current member, numeral 4 designates a fixed ring, numeral 5 designates a cylinder type housing, numeral 6 designates a bearing device, numeral 7 designates a permanent magnet, numeral 8 designates a drive motor, notation 8' designates a pulley driven and rotated by an engine, numeral 9 designates a rotating disk, notation 9-1 designates a ring gear, notation 9-2 designates a pinion gear, numeral 10 designates a flange joint, notation 10-1 fastening flanges 10-1, notation 10-2 designates a joint bolt, numeral 11 designates a heat radiating fin, numeral 12 designates a heat exchange core member, notation 12-1 designates a honeycomb core member, numeral 13 designates an engine, numeral 14 designates an engine cooling water pipe, numeral 15 designates a heater core and notation V designates a valve, respectively.

That is, in the magnet type heater 1-1 shown by FIG. 1, the conductor pipe 3 externally fitted to the fluid pipe 2 is fixed by the fixed rings 4 externally fitted to both sides of the conductor and the cylinder type housing 5 is rotatably supported by outer peripheries of the fixed rings 4 via the bearing devices 6 to surround the conductor pipe 3. The inner periphery of the cylinder type housing 5 is attached with the permanent magnet 7 in a cylindrical shape arranged to be opposed to the conductor pipe 3 with a small gap therebetween via a yoke 7*a*. The rotating disk 9 installed at a rotating shaft of the drive motor 8 is brought into contact with the outer peripheral face of the cylinder type housing 5 and the cylinder type housing 5 is rotated by starting the drive motor 8 via the rotating disk 9. Further, the conductor pipe 3 is constituted by a hysteresis member or by pasting an eddy current member on a surface of the magnet side of a base member of the hysteresis member or an iron member, an alnico member or the like.

In the magnet type heater 1-1 having the above-described constitution, when the drive motor 8 is started, the cylinder type housing 5 is rotated around the pipe shaft via the rotating disk 9 installed at the rotating shaft and the permanent magnet 7 is rotated around the conductor pipe 3 by which magnetic paths formed between the conductor pipe 3 and the permanent magnet 7 are sheared and slip heat generation is caused in the conductor 3. Heat generated by the conductor pipe 3 is exchanged by a fluid in the fluid pipe 2 to thereby carry out heating.

Figure 2:
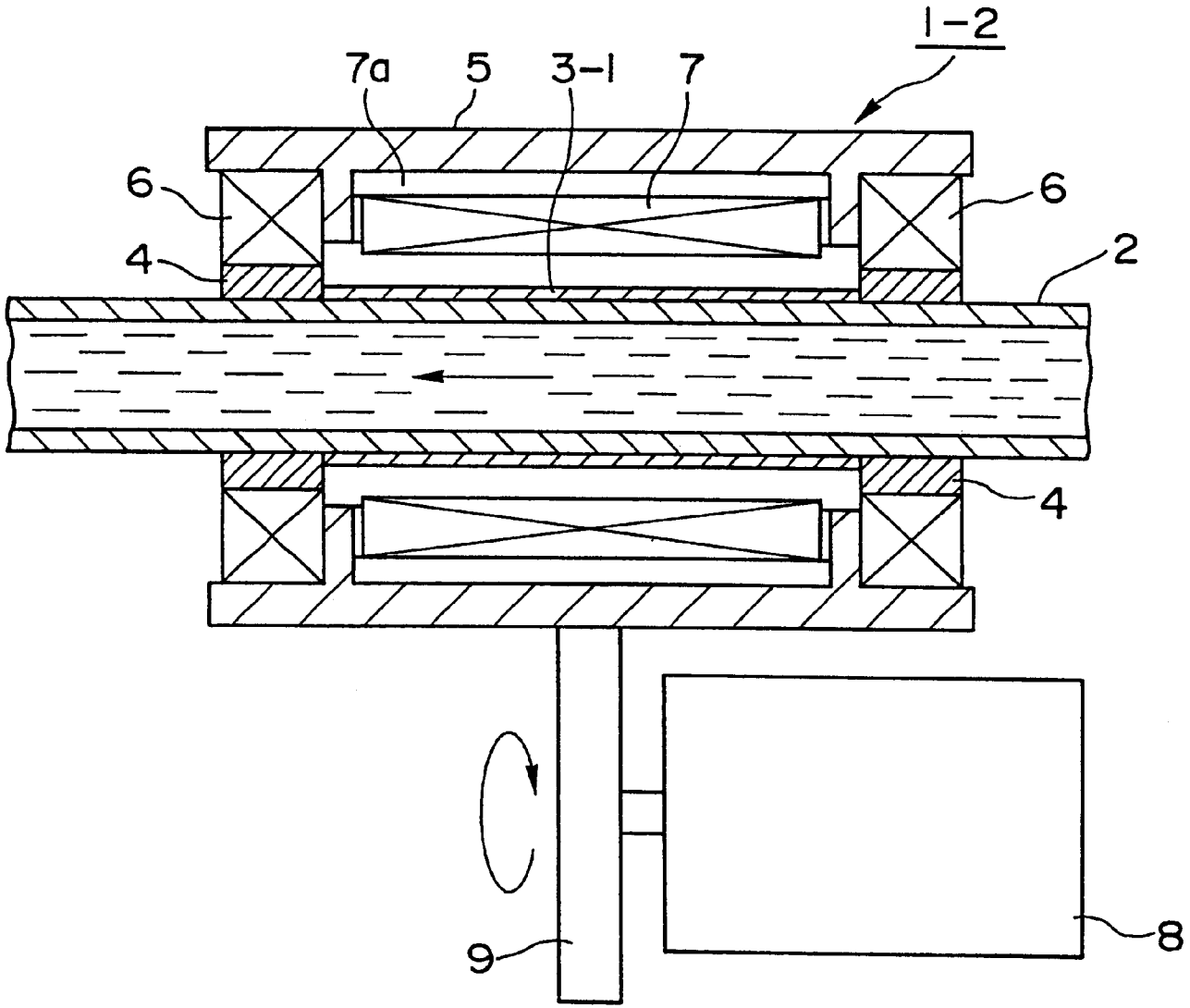
FIG. 2 is a figure in correspondence with FIG. 1 similarly showing a second embodiment.

Next, according to the magnet type heater 1-2 shown by FIG. 2, the fluid pipe 2 is used as a conductor and since the fluid pipe 2 is generally an iron pipe, with the fluid pipe 2 as a base member, the eddy current member 3-1 made of copper in a cylindrical shape is pasted on the external side of the pipe to thereby constitute a conductor.

In the case of the magnet type heater 1-2 shown by FIG. 2, when the drive motor 8 is started, the cylinder type housing 5 is rotated around the pipe shaft via the rotating disk 9 installed at the rotating shaft and the permanent magnet 7 in a cylindrical shape is rotated around the eddy current member 3-1 by which magnetic paths formed between the fluid pipe 2 which is a conductor as well as the eddy current member 3-1 and the permanent magnet 7 are sheared and slip heat generation is mainly caused at the eddy current member 3-1.

Figure 3:
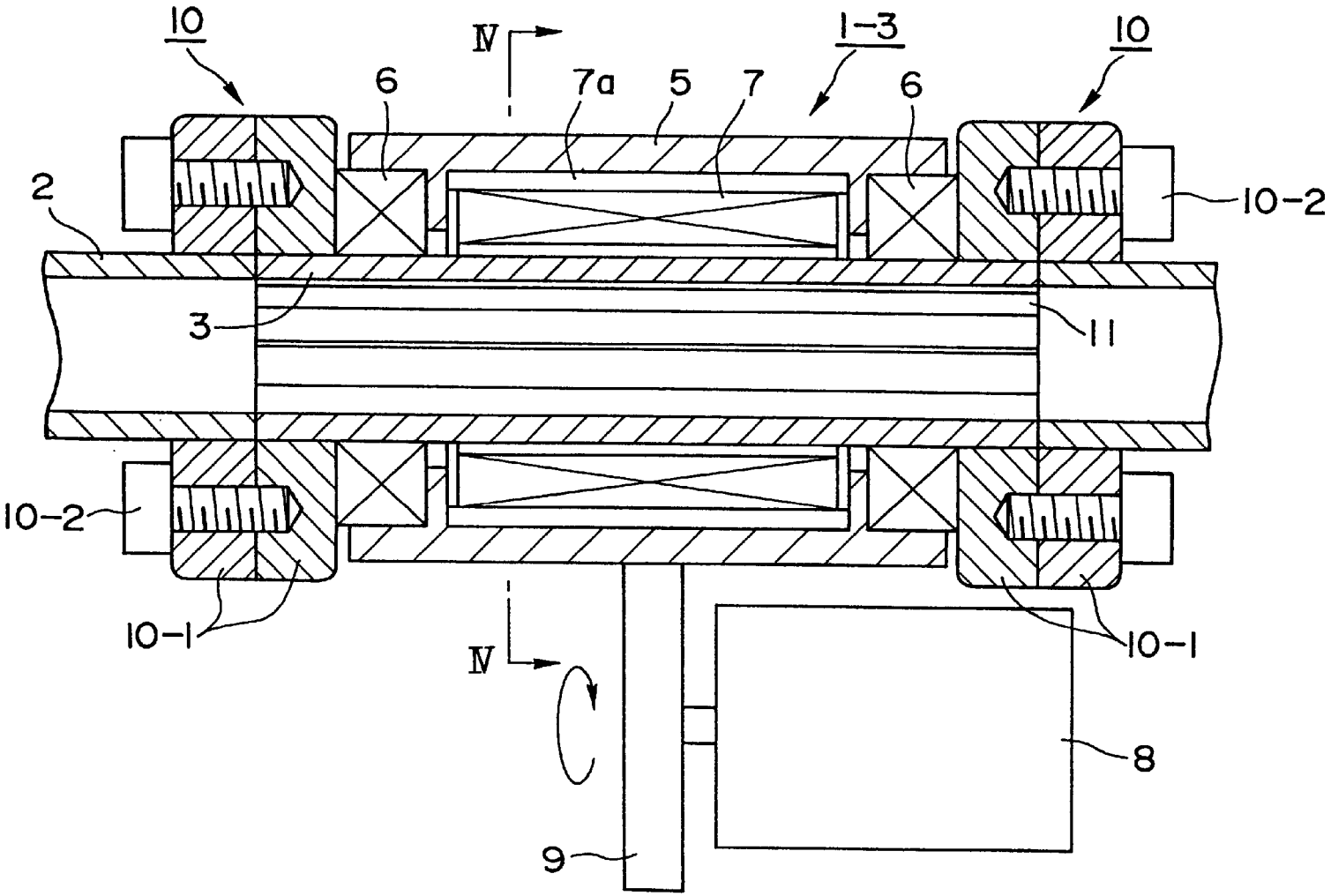
FIG. 3 is a figure in correspondence with FIG. 1 similarly showing a third embodiment.
Figure 4:
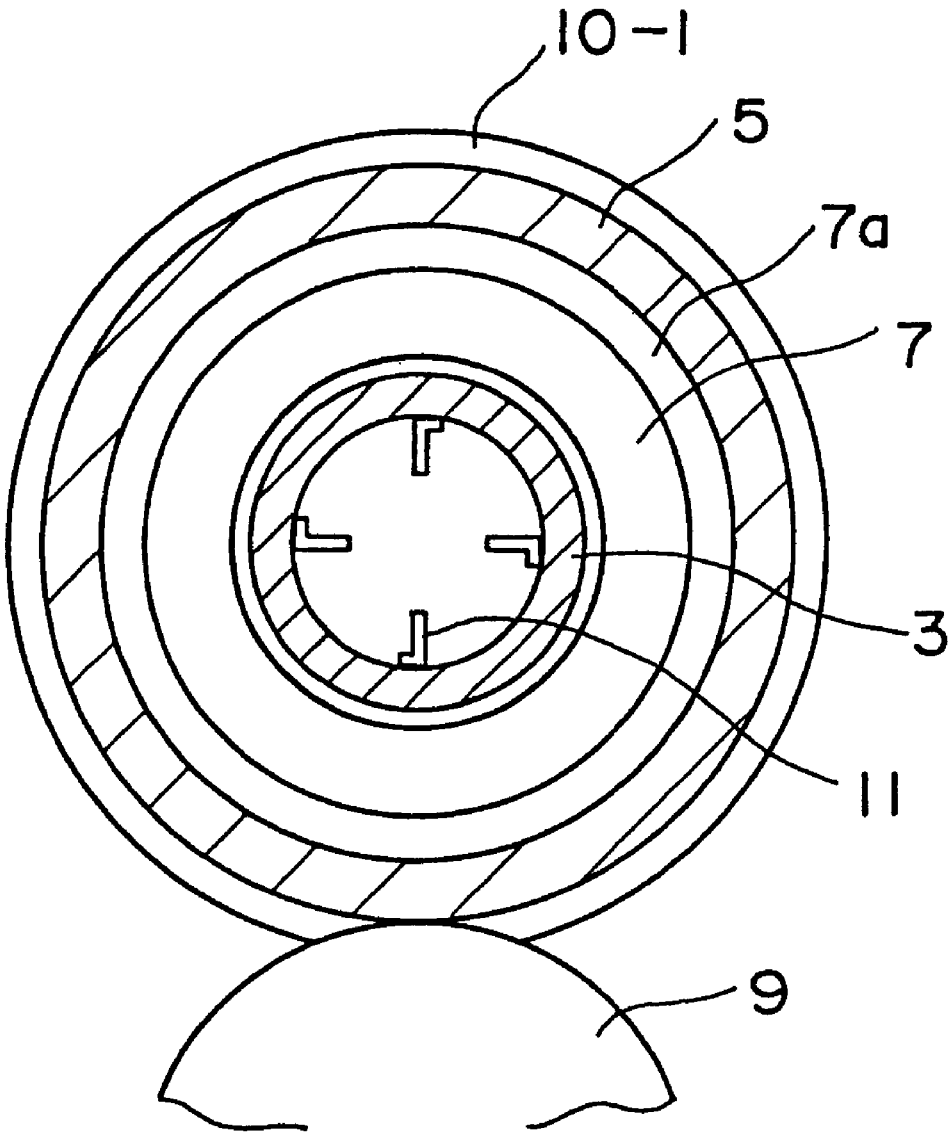
FIG. 4 is a vertical sectional taken along a line IV—IV of FIG. 3.

Further, according to the magnet type heater 1-3 shown by FIG. 3, a portion of the fluid pipe 2 is cut and the magnet type heater integrated separately from the fluid pipe 2 is integrated to the cut portion. According to the structure, the outer periphery of the conductor pipe 3 having an inner diameter the same as an inner diameter of the fluid pipe 2 and having the heat generating fin 11 at an inner peripheral face thereof, rotatably supports the cylinder type housing 5 attached via the yoke 7*a* with the permanent magnet 7 in a cylindrical shape arranged to be opposed to the conductor pipe 3 with a small gap therebetween, via the bearing device 6 and the magnet type heater 1-3 is integrated to the fluid pipe 2 by the flange joints 10 comprising the fastening flanges 10-1 which are externally and fixedly fitted to both end portions of the conductor pipe 3 and respective joint pipe end portions of the fluid pipe 2 and the joint bolts 10-2 for fastening the flanges.

Figure 5:
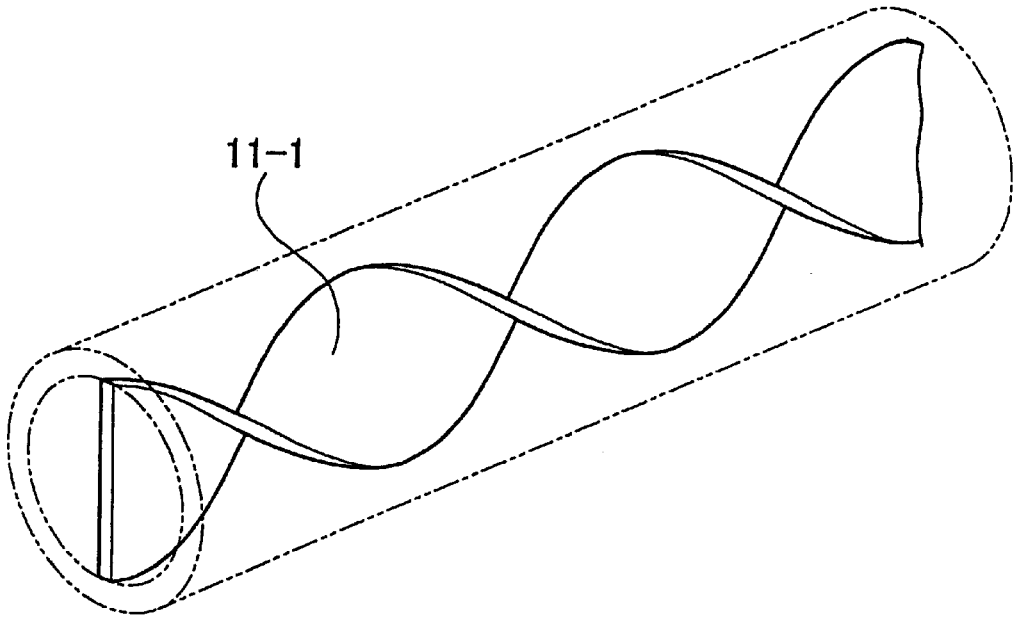
FIGS. 5A and 5B exemplify kinds of fins in FIG. 3.
Figure 5:
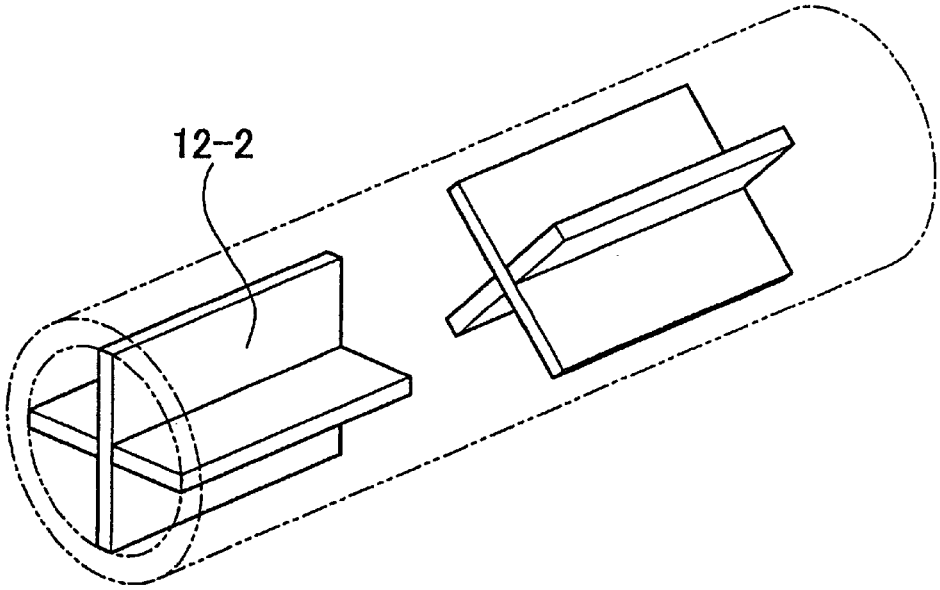

Further, as the heat radiating fin 11 in the magnet type heater 1-3 shown by FIG. 3, there can be used a heat radiating fin 11-1 of a ribbon type shown by FIG. 5A or a fin 11-2 in a cross type shown by FIG. 5B. The ribbon type heat radiating fin 11-1 is formed by twisting one sheet of a plate member having a slender width such that a total length thereof becomes substantially the same as the conductor pipe 3 and the ribbon type heat radiating fin 11-1 is inserted into the conductor pipe 3 and pertinent portions thereof are fixedly attached to an inner wall of the pipe by soldering or the like. Further, the cross type fin 11-2 is constituted by, for example, integrating two sheets of flat plates having a short length in a cross shape and the cross type fins 11-2 are arranged at intervals in the pipe shaft direction while changing phases thereof to thereby constitute the heat radiating fin. Pertinent portions of the cross type fin 11-2 are fixed to the inner wall of the pipe by soldering or the like.

In the case of the magnet type heater 1-3 shown by FIG. 3, the conductor pipe 3 constitutes the cut portion of the fluid pipe 2. In operating the magnet type heater 1-3, similar to the magnet type heater 1-1 shown by FIG. 1, when the drive motor 8 is started, the cylinder type housing 5 is rotated around the pipe shaft via the rotating disk 9 installed at the rotating shaft and the permanent magnet 7 is rotated around the conductor pipe 3 by which magnetic paths formed between the conductor pipe and the permanent magnet 7 are sheared, slip heat generation is generated in the conductor pipe 3 and the slip heat generation is thermally exchanged by the fluid in the conductor pipe 3 to thereby carry out heating operation. Further, when the heat radiating fin 11 is installed in the conductor pipe 3, the efficiency of heat exchange with the fluid in the fluid pipe 2 is promoted by increasing the heat conduction area.

Further, the rotational drive system of the cylinder type housing 5 according to the embodiments shown by FIG. 1 through FIG. 3, is not limited to the motor drive system, as mentioned above, but, for example, the cylinder type housing 5 may be driven by an engine via a pulley or the like. Further, there can be pertinently be used a desired drive system such that there are installed gears on the outer peripheral face of the cylinder type housing 5 and the outer peripheral face of the rotating disk 9 and the gears are in mesh with each other or a belt may be installed to extend between the outer peripheral face of the cylinder type housing 5 and the outer peripheral face of the rotating disk 9 to thereby carry out belt driving.

Figure 6:
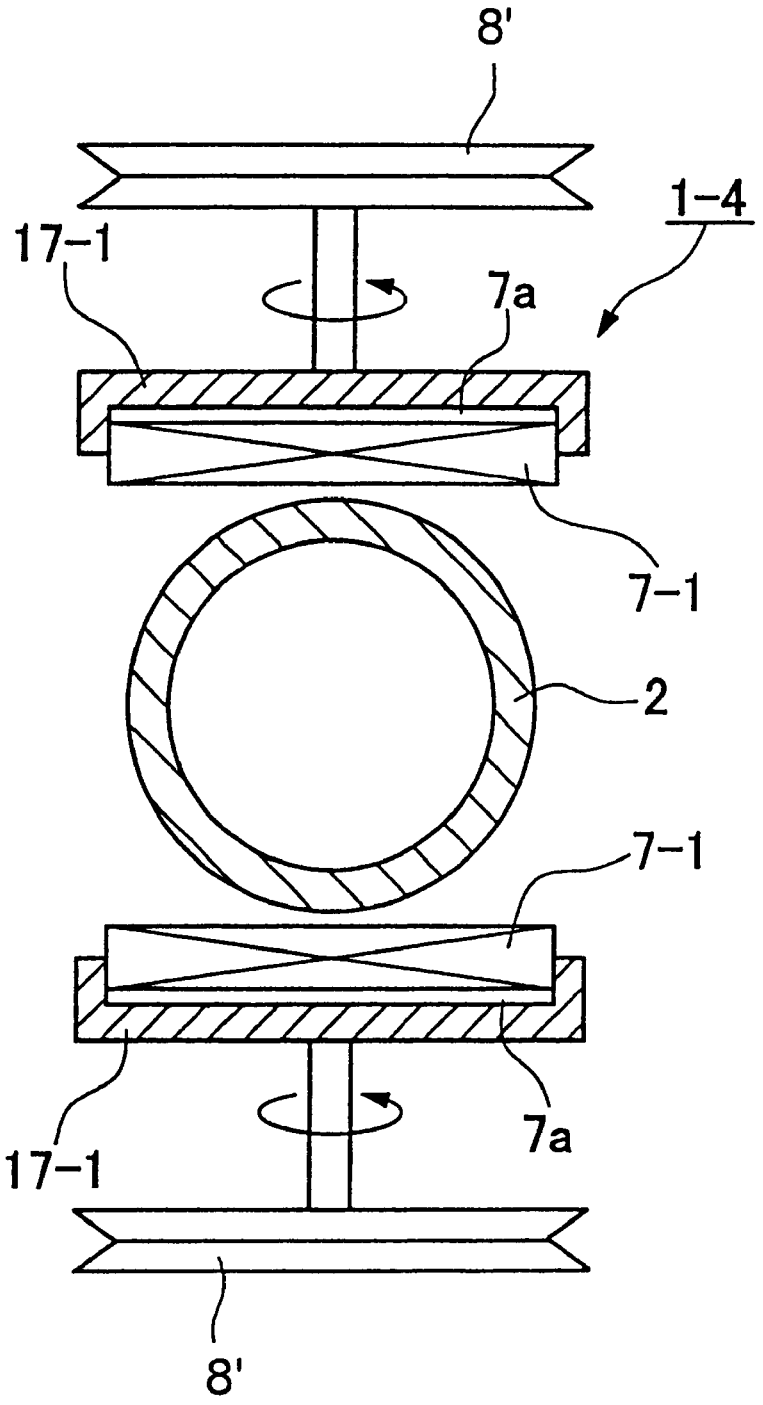
FIG. 6 is a vertically cut front view similarly showing a fourth embodiment.

According to the magnet type heater 1-4 shown by FIG. 6, the fluid pipe 2 is made of a conductor and on external sides of the fluid pipe 2 made of a conductor, 2 pieces of the circular disk type permanent magnets 7-1 each comprising a plurality of segments attached to magnet supporters 17-1 via the yokes 7*a*, are arranged to be opposed to the pipe on a center line in the radius direction of the pipe on planes in parallel with the pipe shaft direction of the fluid pipe 2 made of a conductor rotatably with a small gap therebetween. Each of the pair of circular disk type permanent magnets 7-1 is rotatably supported by the pulley 8' driven by the engine and rotated by rotating the respective pulley 8' on the plane in parallel with the pipe shaft direction of the fluid pipe 2 made of a conductor, preferably in the same direction and with the same rotational speed.

According to the magnet type heater 1-4 having the constitution shown by FIG. 6, when the respective pulleys 8' are rotated by driving the engine, the pair of circular disk type permanent magnets 7-1 are respectively rotated on the planes in parallel with the pipe shaft direction of the fluid pipe 2 made of a conductor by which magnetic paths formed between the pair of circular disk type permanent magnets 7-1 and the fluid pipe 2 are sheared and slip heat generation is generated in the fluid pipe 2 made of a conductor. The generated heat of the fluid pipe 2 made of conductor is thermally exchanged by the fluid in the fluid pipe 2 to thereby carry out heating operation.

Figure 7:
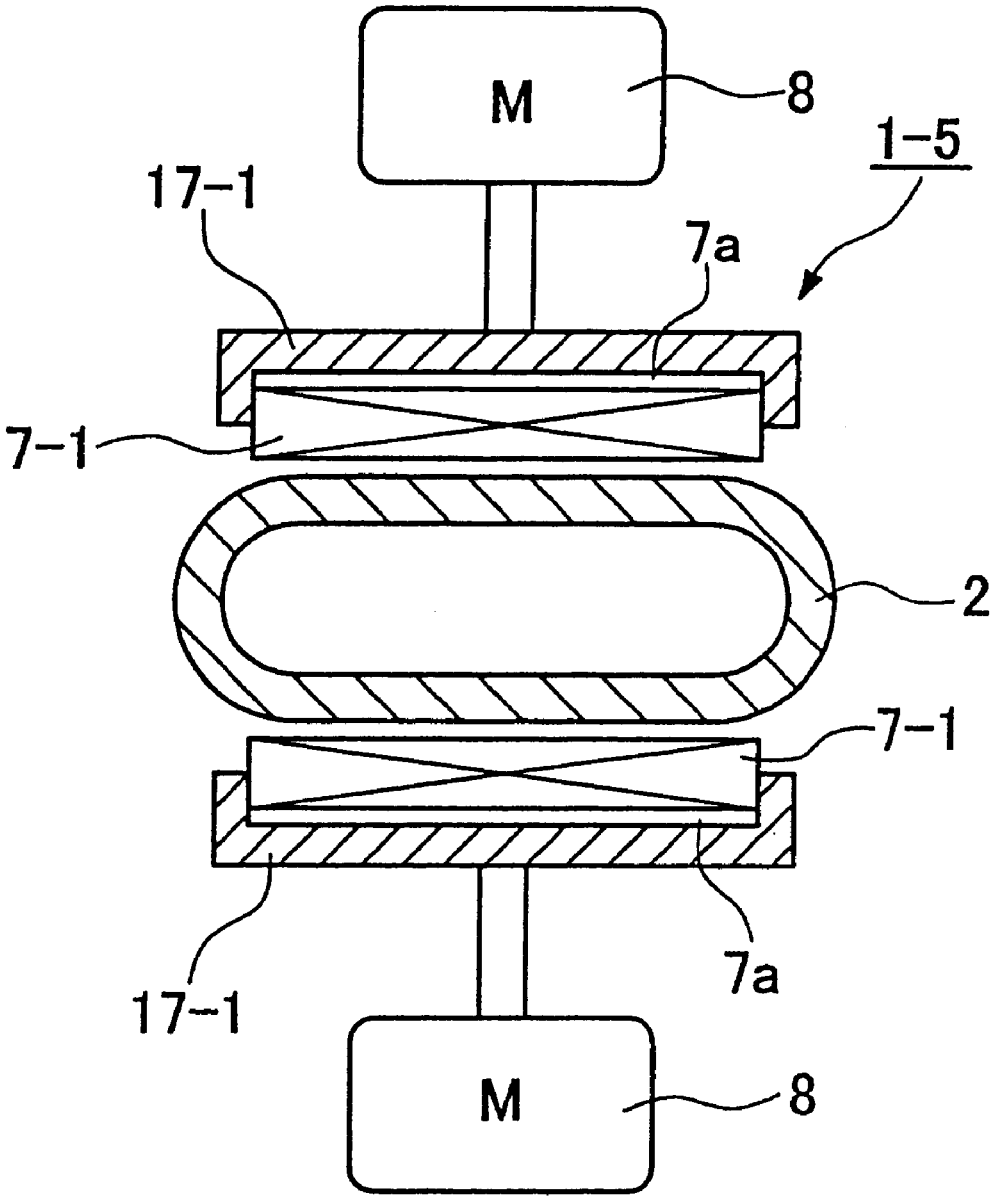
FIG. 7 is a vertically cut front view similarly showing a fifth embodiment.

According to the magnet type heater 1-5 shown by FIG. 7, in the magnet type heater 1-4 having the constitution shown by FIG. 6, in order to improve the energy efficiency by making constant distances between the circular disk type permanent magnets 7-1 and pipe wall faces of the pipe 2, the section of the pipe opposedly arranged with the circular disk type permanent magnets 7-1 attached to the magnet supporters 17-1 via the yokes 7-*a*, is formed in a flattened shape such as an oval shape or an elliptic shape and the pair of circular disk type permanent magnets 7-1 are supported on the external sides of the fluid pipe 2 made of conductor in the flattened shape respectively rotatably by the drive motors 8, preferably in the same direction and with the same speed.

Accordingly, in the case of the magnet type heater 1-5 having the constitution shown by FIG. 7, stable magnet paths are formed between the fluid pipe 2 made of a conductor in the flattened shape and the circular disk type permanent magnets 7-1 by which slip heat generation is efficiently generated in the fluid pipe 2 made of a conductor in the flattened shape.

Figure 8:
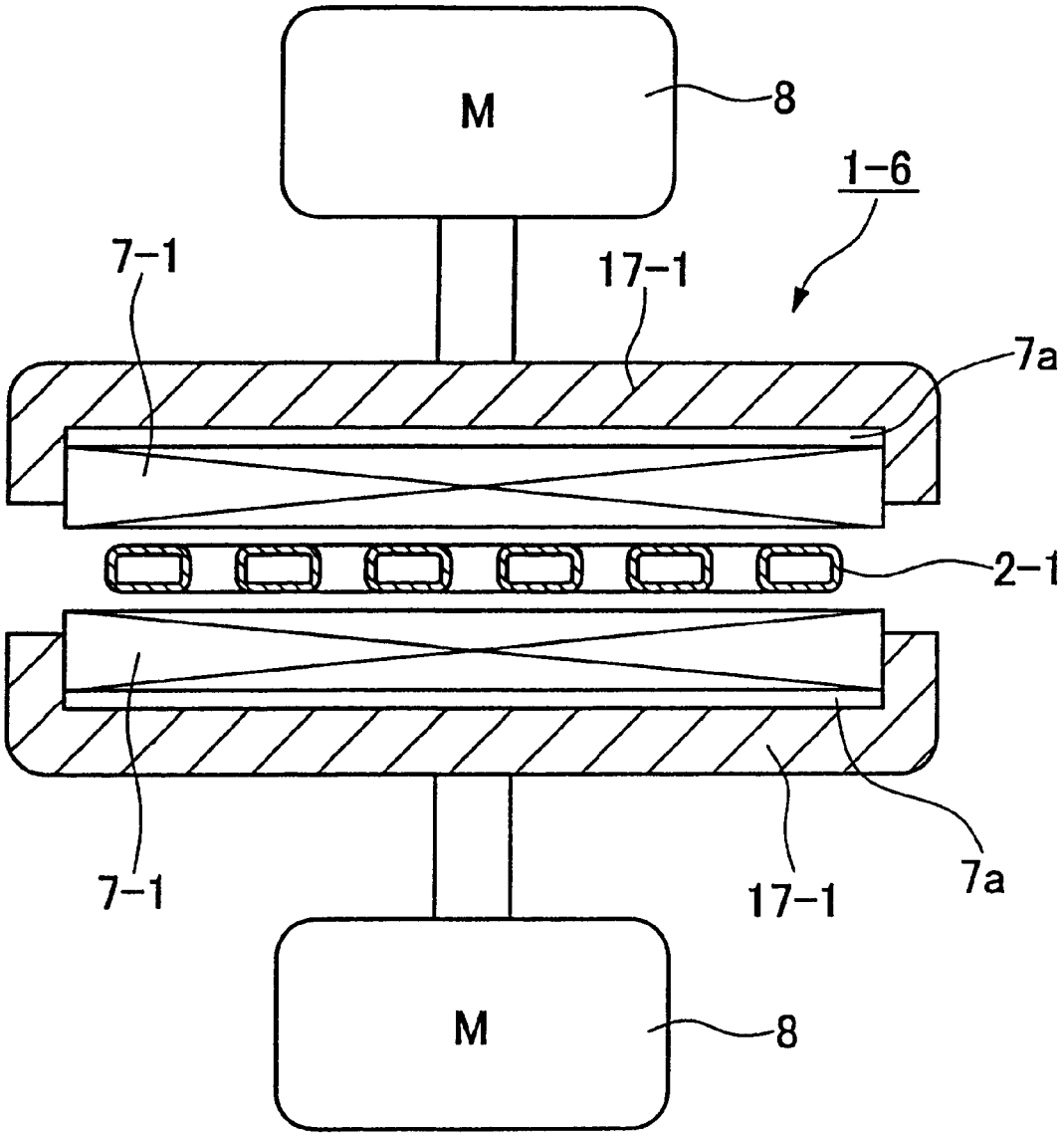
FIG. 8 is a vertically cut front view similarly showing a sixth embodiment.

According to the magnet type heater 1-6 shown by FIG. 8, the pipe portion arranged to be opposed to the circular disk type permanent magnets 7-1 of the fluid pipe 2 made of a conductor is constituted by a plurality of pieces of fluid pipes 2-1 made of a conductor in place of the fluid pipe 2 made of a conductor in the flattened shape shown by FIG. 7. In this case, the pipe portions which are arranged to be opposed to the circular disk type permanent magnets 7-1 of the fluid pipe 2 made of a conductor having the circular shape section are constituted by branching the plurality of pieces of fluid pipes 2-1 made of a conductor having the flattened shape on the same face from the fluid pipe 2 made of a conductor having the circular section. On the external sides of the group of pipes constituted by the plurality of pieces of fluid pipes 2-1 made of a conductor having the section in the flattened shape, the circular disk type permanent magnets 7-1 which are attached to the magnet supporters 17-1 via the yokes 7*a* are arranged to be opposed to the group of pipes with small gaps therebetween. Also in this case, the pair of circular disk type permanent magnets 7-1 are rotatably supported rotatably by the drive motors 8 respectively on the planes in parallel with the pipe shaft direction of the group of pipes and are rotated on the planes in parallel with the pipe shaft direction of the fluid pipe 2 made of a conductor by starting the respective drive motors 8, preferably in the same direction and with the rotational speed.

According to the magnet type heater 1-6 having the constitution shown by FIG. 8, when the respective drive motors 8 are started, the pair of circular disk type permanent magnets 7-1 are rotated on the planes in parallel with drive shaft directions of the plurality of pieces of fluid pipes 2-1 made of a conductor each having the section in the flattened shape by which magnetic paths formed between the pair of circular disk type permanent magnets 7-1 and the fluid pipes 2-1 made of a conductor are sheared and slip heat generation is generated in the fluid pipes 2-1 made of a conductor. Further, also in this case, by forming stable magnetic paths between the plurality of pieces of the fluid pipes 2-1 made of a conductor in the flattened shape and the circular disk type permanent magnets 7-1, slip heat generation is efficiently generated in the plurality of pieces of fluid pipes 2-1 made of a conductor in the flattened shape and is thermally exchanged by the fluid in the fluid pipes 2-1 to thereby carry out heating operation.

Figure 9:
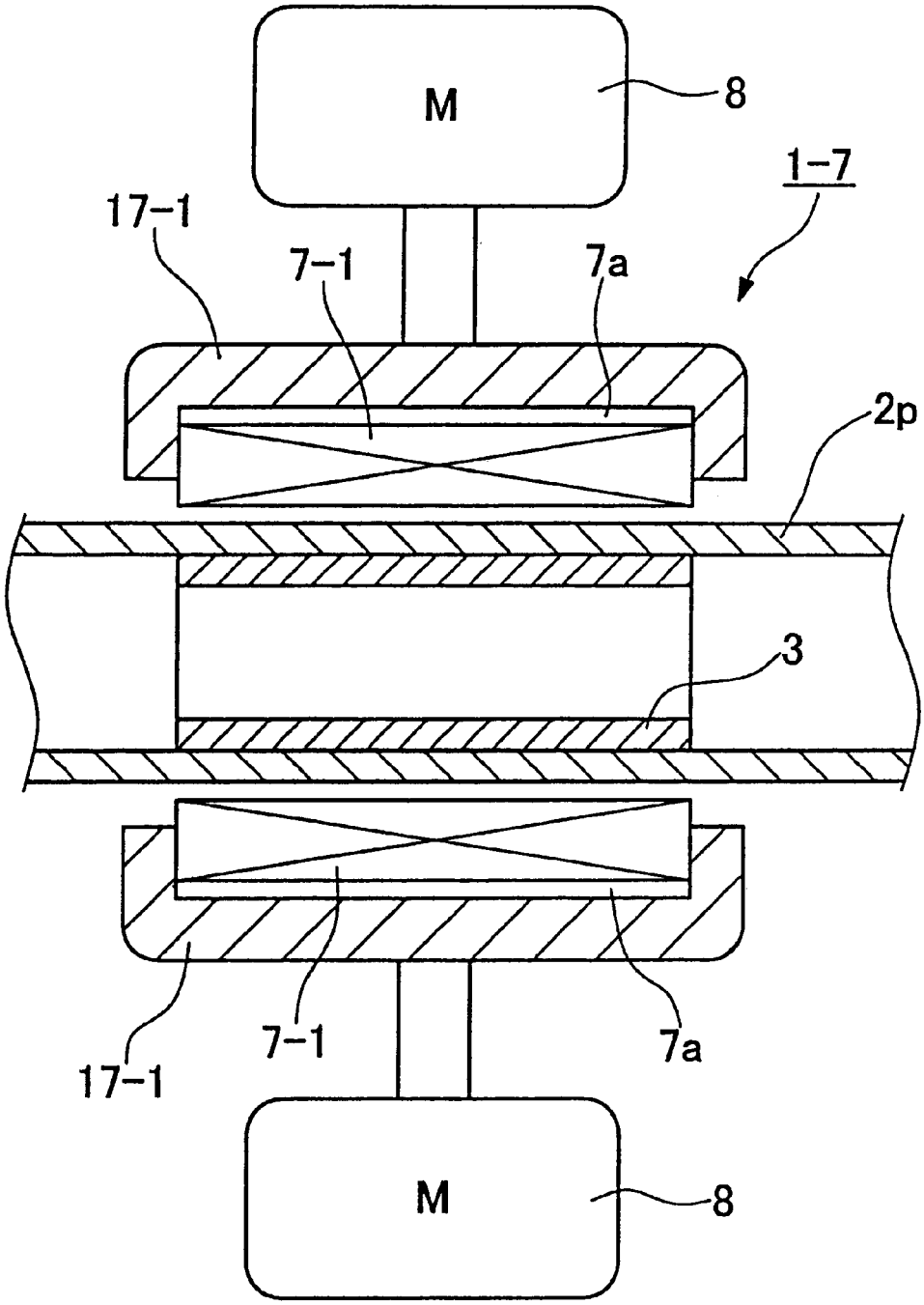
FIG. 9 is a vertically cut side view similarly showing a seventh embodiment.

The magnet type heater 1-7 shown by FIG. 9 is applied to a fluid pipe made of a resin. In this case, the pipe 3 made of a conductor having a predetermined length is internally fitted fixedly to inside of a fluid pipe 2P made of a resin. The circular disk type permanent magnets 7-1 attached to the magnet supporters 17-1 via the yokes 7*a* similar to the above-described are arranged to be opposed to the fluid pipe 2P made of a resin with a very small gap between the circular disk type permanent magnets 7-1 and the fluid pipe 2P made of a resin at positions on the outer sides of the pipe to be opposed to the pipe 3 made of a conductor via the pipe wall of the fluid pipe 2P made of a resin. Also in this case, the pair of circular disk type permanent magnets 7-1 are supported rotatably by the drive motors 8 respectively on the planes in parallel with the pipe shaft direction of the group of pipes and rotated on the planes in parallel with the pipe shaft direction of the fluid pipe 3 made of a conductor by starting the respective drive motors 8, preferably in the same direction and with the same rotational speed.

According to the magnet type heater 1-7 having the constitution shown by FIG. 9, when the respective drive motors 8 are started, by rotating the pair of circular disk type permanent magnets 7-1 respectively on the planes in parallel with the pipe shaft direction of the fluid pipe 2P made of a resin, magnetic paths formed between the pair of circular disk type permanent magnets 9-1 and the fluid pipe 2P made of a resin as well as the pipe 3 made of a conductor at inside of the fluid pipe 2P are sheared and slip heat generation is generated in the pipe 3 made of a conductor. The heat generated in the pipe 3 made of a conductor is thermally exchanged by the fluid in the fluid pipe 2P made of a resin to thereby carry out heating operation. However, in the case of the magnet type heater 1-7, the magnetic paths formed between the circular disk type permanent magnets 7-1 and the pipe 3 made of a conductor are formed via the pipe wall of the fluid pipe 2P made of a resin and accordingly, in comparison with the respective magnet type heaters, mentioned above, having no intermediary object between the permanent magnet and the conductor, the heat generation efficiency is more or less lowered.

Next, an explanation will be given of a magnet type heater of a system incorporating a heat exchange core in a fluid pipe made of a conductor in reference to FIG. 10A through FIG. 16.

First, according to the magnet type heater 1-8 shown by FIGS. 10A and 10B, the inner periphery of the cylinder type housing 5 rotatably supported by the outer peripheries of the fixed rings 4 externally fitted to the fluid pipe 2 made of a conductor via the bearing devices 6, is attached with the permanent magnet 7 in a cylindrical shape arranged to be opposed to the fluid pipe 2 made of a conductor with a small gap therebetween via the yokes 7*a*. Further, the heat exchange core 12 is incorporated in the fluid pipe 2 made of a conductor at a position to be opposed to the permanent magnet 7 in the cylindrical shape. As shown by, for example, FIG. 10B, as the heat exchange core 12, there can be used a core having a honeycomb structure in which flat plates and wavy plates made of a magnetic material are laminated and wound. Further, the honeycomb structure member as the heat exchange core is preferably constituted by a metal carrier normally used for purifying emission gas of an engine in view of vibration resistance performance and heat resistance performance.

Further, the cylinder type housing 5 is rotated by the drive motor 8 via the pinion gear 9-2 in mesh with the ring gear 9-1 attached to the outer peripheral face.

Figure 10:
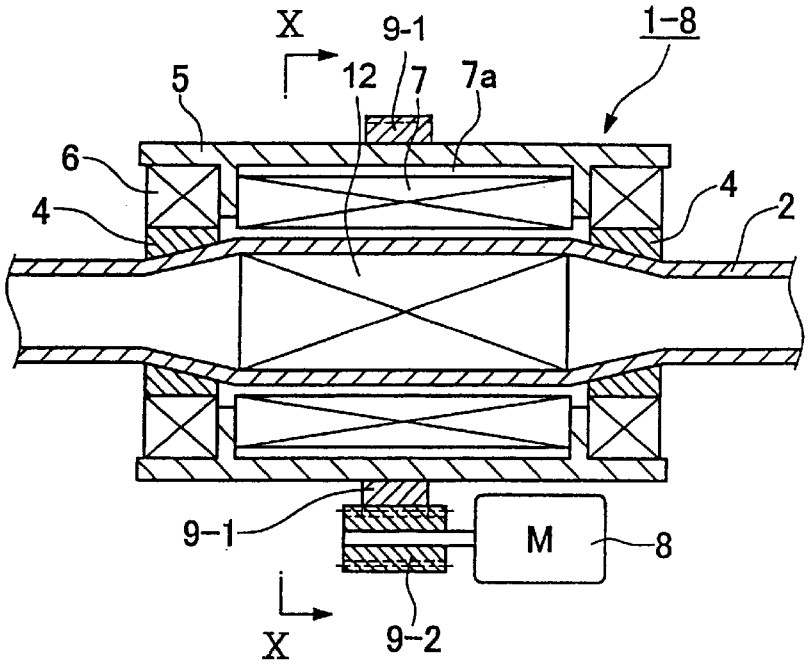
FIGS. 10A and 10B similarly show an eighth embodiment.
Figure 10:
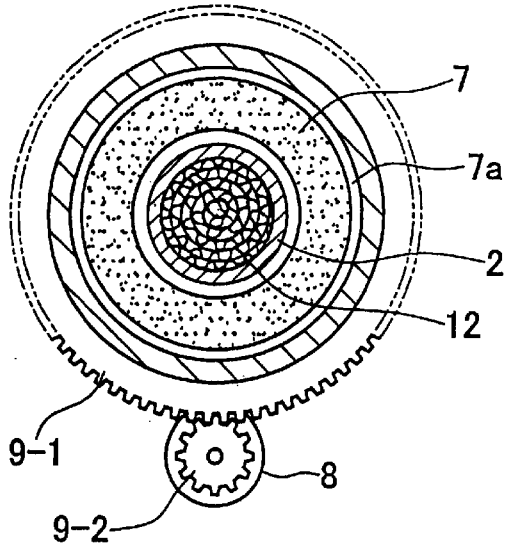
Figure 11:
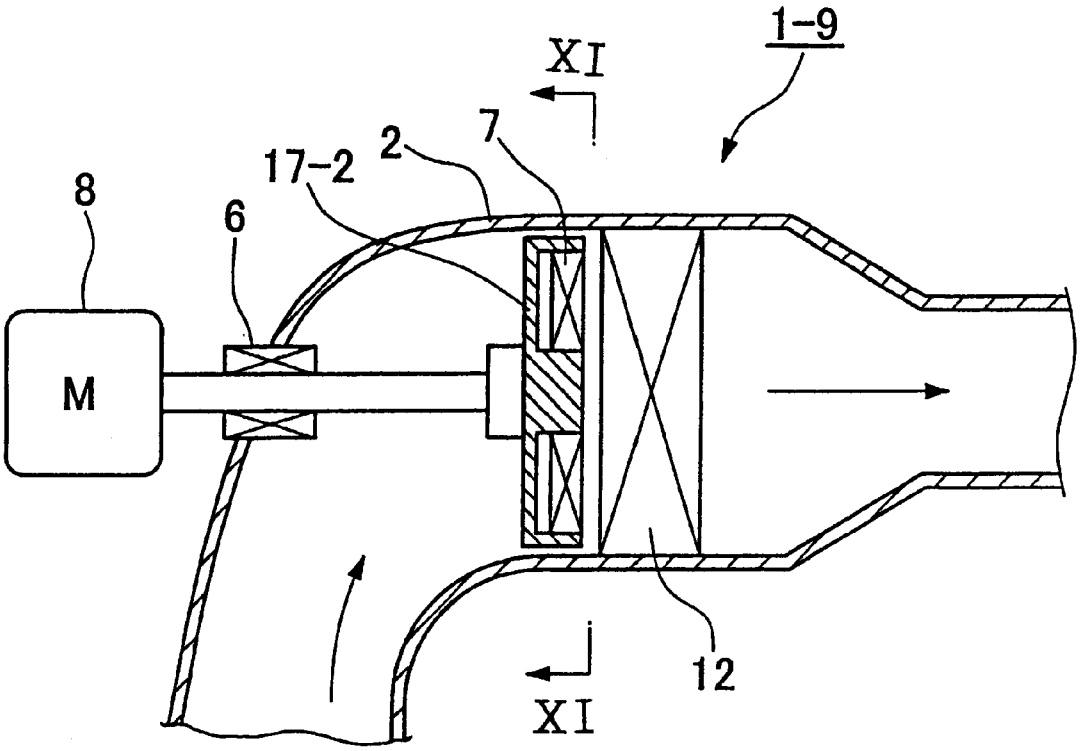
FIGS. 11A and 11B similarly show a ninth embodiment.
Figure 11:
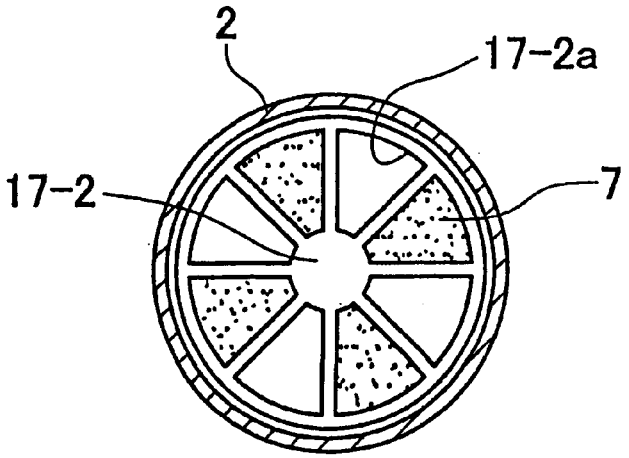
Figure 12:
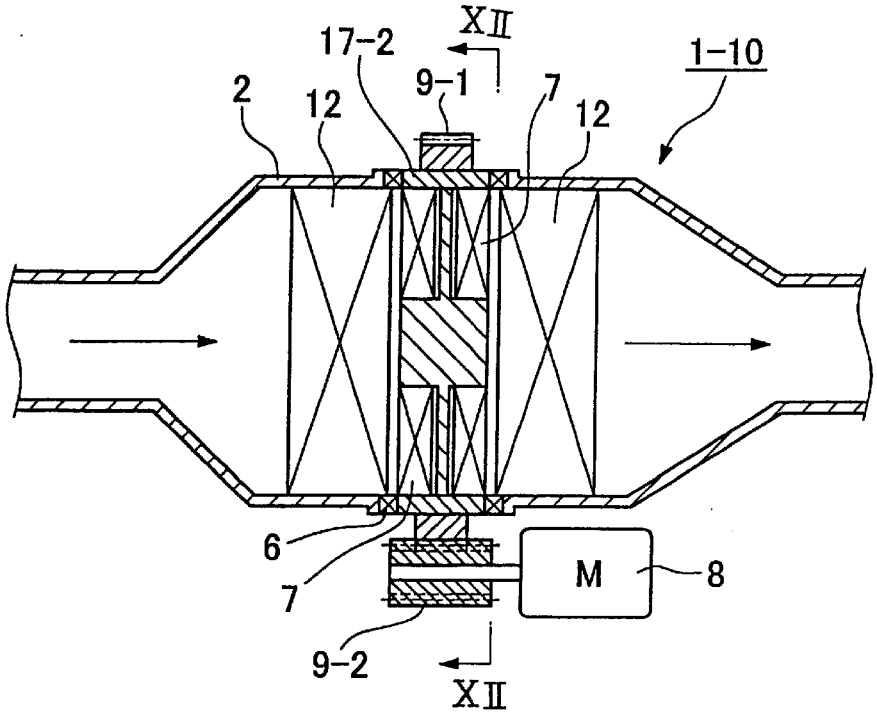
FIGS. 12A and 12B similarly show a tenth embodiment.
Figure 12:
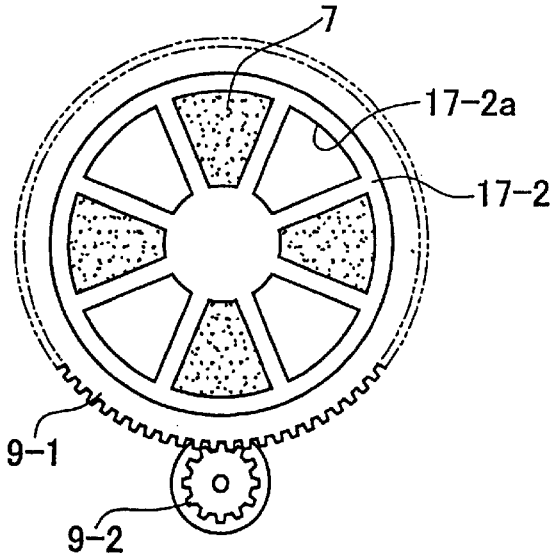

According to the magnet type heater 1-8 having the constitution shown by FIG. 10, when the drive motor 8 is started, the cylinder type housing 5 is rotated around the pipe shaft via the pinion gear 9-2 installed to the rotating shaft and the ring gear 9-1 in mesh with the gear 9-2 and the permanent magnet 7 is rotated around the fluid pipe 2 made of a conductor by which magnetic paths formed between the fluid pipe 2 made of a conductor and the permanent magnet 7 are sheared and slip heat generation is generated in the fluid pipe 2 made of a conductor. The generated heat of the fluid pipe 2 made of a conductor heats the heat exchange core 12 arranged in the fluid pipe 2 made of a conductor and thermally exchanged by the fluid flowing in the core to thereby carry out heating operation.

According to the magnet type heater 1-9 shown by FIGS. 11A and 11B, a heat exchange core made of a conductor (for example, made of ferrite series steel) 12 is installed in the fluid pipe 2 made of a conductor or a nonconductor. The permanent magnet 7 in a segment shape arranged to be opposed to the heat exchange core made of a conductor with a very small gap therebetween is rotatably supported in the fluid pipe via the bearing device 6 upstream from the heat exchange core 12 made of a conductor. As shown by FIG. 11B, portions of the permanent magnet 7 are installed to the magnet supporter 17-2 having communication hole 17-2*a* on a face thereof opposed to the heat exchange core 12 made of conductor alternately with the communication holes 17-2*a* and are constituted to be driven to rotate by the drive motor 8 installed on the outer side of the fluid pipe 2. Also in this case, as the heat exchange core 12 made of a conductor, there can be used a core having a honeycomb structure made of a magnetic material in which flat plates and wavy plates are laminated and wound similar to the above-described.

In the case of the magnet type heater 1-9 having the constitution shown by FIGS. 11A and 11B, when the drive motor 8 is started, the permanent magnet 7 attached to the magnet supporter 17-2 with the communication holes 17-2*a* supported by the rotating shaft is rotated by which magnetic paths formed between the permanent magnet 7 and the heat exchange core 12 made of a conductor are sheared and slip heat generation is generated in the heat exchange core 12 made of a conductor. The generated heat of the heat exchange core 12 made of a conductor is thermally exchanged by the fluid passing through the communication holes 17-2*a* of the magnet supporter 17-2 installed on the upstream side of the core and flowing in the core to thereby carry out the heating operation.

The magnet type heater 1-10 shown by FIGS. 12(A) and 12(B) is a heater of a system in which heat exchange cores made of a conductor are arranged in tandem in the fluid pipe. According to the structure, the heat exchange cores 12 made of a conductor are arranged on the downstream side and the upstream side of the fluid pipe 2 made of a conductor or a nonconductor and between the heat exchange cores 12 on the upstream side and on the downstream side, the magnet supporter 17-2 with the communication holes 17-2*a* having portions of the permanent magnet 7 arranged to be opposed to the respective heat exchange cores made of a conductor with small gaps therebetween, is rotatably supported via the bearing devices 6. The magnet supporter 17-2 is rotated by the drive motor 8 via the pinion gear 9-2 in mesh with the ring gear 9-1 attached to the outer peripheral face. Further, the magnet supporter 17-2 with the communication holes 17-2*a* is constituted by a structure in which the communication holes 17-2*a* are perforated at a face thereof opposed to the heat exchange core 12 made of a conductor alternately with portions of the permanent magnet 7 in the segment shape similar to that shown by FIGS. 11A and 11B. Also in this case, as the heat exchange core 12 made of a conductor, there can be used a core having the honeycomb structure made of a magnetic material in which flat plates and wavy plates are laminated and wound similar to the above-described.

In the case of the magnet type heater 1-10 having the constitution shown by FIGS. 12A and 12B, when the drive motor 8 is started, the magnet supporter 17-2 is rotated around the pipe shaft via the pinion gear 10-2 installed to the rotating shaft and the ring gear 9-1 in mesh with the pinion gear 9-2 by which magnetic paths formed between the heat exchange cores 12 on the upstream side and on the downstream side and the respective portions of the permanent magnet 7 are sheared and slip heat generation is generated in the respective heat exchange cores 12 made of a conductor. The generated heat of the heat exchange core 12 made of a conductor is thermally exchanged by the fluid flowing in the core to thereby carry out heating operation.

Figure 13:
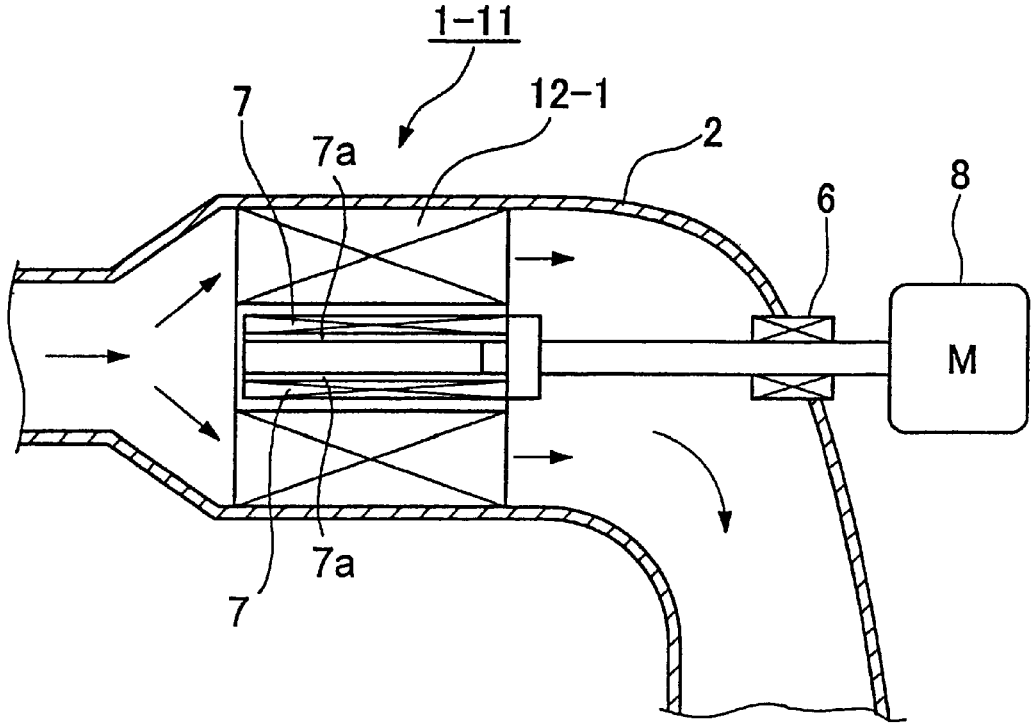
FIG. 13 is a vertically cut side view similarly showing an eleventh embodiment.

The magnet type heater 1-11 shown by FIG. 13 is a heater using a hollow heat exchange core made of a conductor. According to the structure, a hollow heat exchange core 12-1 made of a conductor is arranged in the fluid pipe 2 made of a conductor or a nonconductor, the permanent magnet 7 in a cylindrical shape arranged to be opposed to the inner portion of the hollow heat exchange core 12-1 made of a conductor with a small gap therebetween, is rotatably supported in the fluid pipe via the bearing device 6 and is rotated by the drive motor 8 arranged on the outer side of the fluid pipe 2. Also in this case, as the heat exchange core 12-1 made of a conductor, there can be used a core having a honeycomb structure made of a magnetic material in which flat plates and wavy plates are laminated and wound similar to the above-described. Further, the hollow heat exchange core 12-1 made of a conductor may be attached by using an inner case made of a conductor.

In the case of the magnet type heater 1-11 having the constitution shown by FIG. 13, when the drive motor 8 is started, the permanent magnet 7 in the cylindrical shape supported by the rotating shaft is rotated by which magnetic paths formed between the permanent magnet 7 and the hollow heat exchange core 12-1 made of a conductor are sheared and slip heat generation is generated in the hollow heat exchange core 12-1 made of a conductor. The generated heat of the hollow heat exchange core 12-1 made of a conductor is thermally exchanged by the fluid flowing in the core to thereby carry out heating operation.

Figure 14:
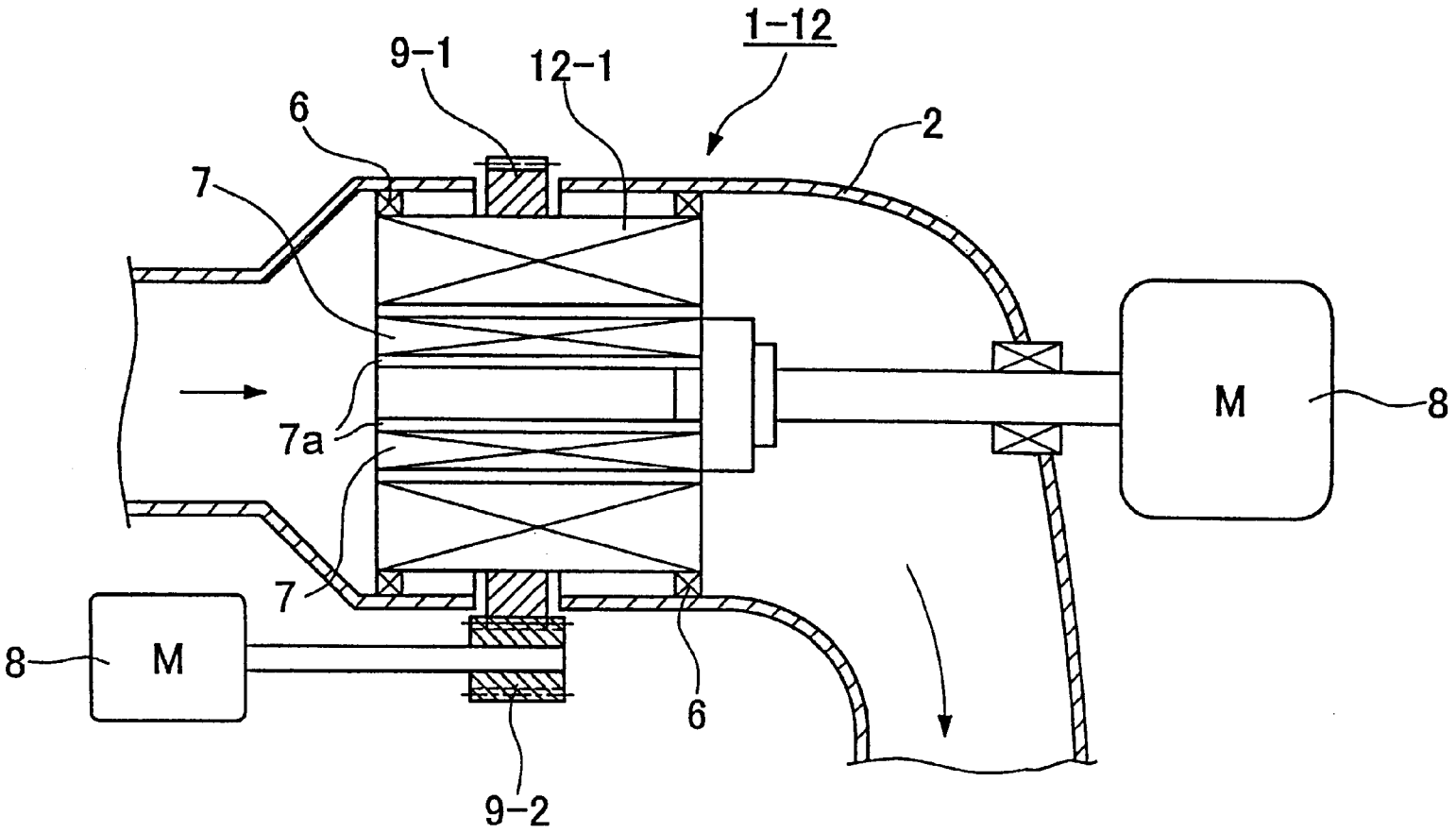
FIG. 14 is a vertically cut side view similarly showing a twelfth embodiment.

The magnet type heater 1-12 shown by FIG. 14 is a heater of a system in which the hollow heat exchange core made of a conductor and the permanent magnet in the cylindrical shape are driven to rotate separately from each other. According to the structure, the hollow heat exchange core 12-1 made of a conductor is supported rotatably around the pipe shaft in the fluid pipe via the bearing device 6 to ride over the fluid pipe in the fluid pipe 2 made of a nonconductor on the upstream side and the downstream side and the hollow heat exchange core 12-1 made of a conductor is rotated by the drive motor 8 via the ring gear 9-1 attached to the outer periphery and the pinion gear 9-2 in mesh with the gear. Meanwhile, the permanent magnet 7 in the cylindrical shape arranged to be opposed to the inner portion of the hollow heat exchange core 12-1 made of a conductor with a small gap therebetween, is rotatably supported in the fluid pipe 2 via the bearing device 6 and is rotated by the drive motor 8 arranged on the outer side of the fluid pipe 2. Also in this case, as the heat exchange core 12-1 made of a conductor, there can be used a core having a honeycomb structure made of a magnetic material in which flat plates and wavy plates are laminated and wound similar to the above-described and the hollow heat exchange core 12-1 made of a conductor may be attached by using an inner case made of a conductor.

In the case of the magnet type heater 1–12 having the constitution shown by FIG. 14, the hollow heat exchange core 12-1 made of a conductor and the permanent magnet 7 in the cylindrical shape can be driven to rotate separately from each other and accordingly, for example, by fixing the side of the permanent magnet 7 and rotating the side of the hollow heat exchange core 12-1 made of a conductor by the drive motor 8, the fluid flowing in the hollow heat exchange core made of a conductor is heated by slip heat generation generated in the hollow heat exchange core made of a conductor. Further, by fixing the side of the hollow heat exchange core 12-1 made of a conductor and rotating the side of the permanent magnet 7 by the drive motor 8, slip heat generation may be generated in the hollow heat exchange core made of a conductor. Further, in the case of the magnet type heater 1-12, the side of the permanent magnet 7 and the side of the hollow heat exchange core 12-1 made of a conductor can be driven to rotate respectively in opposed directions and accordingly, the relative rotational number between the magnet side and the conductor side can be secured in a sufficiently wide range and heat exchange can be carried out with a high heat generation efficiency.

Figure 15:
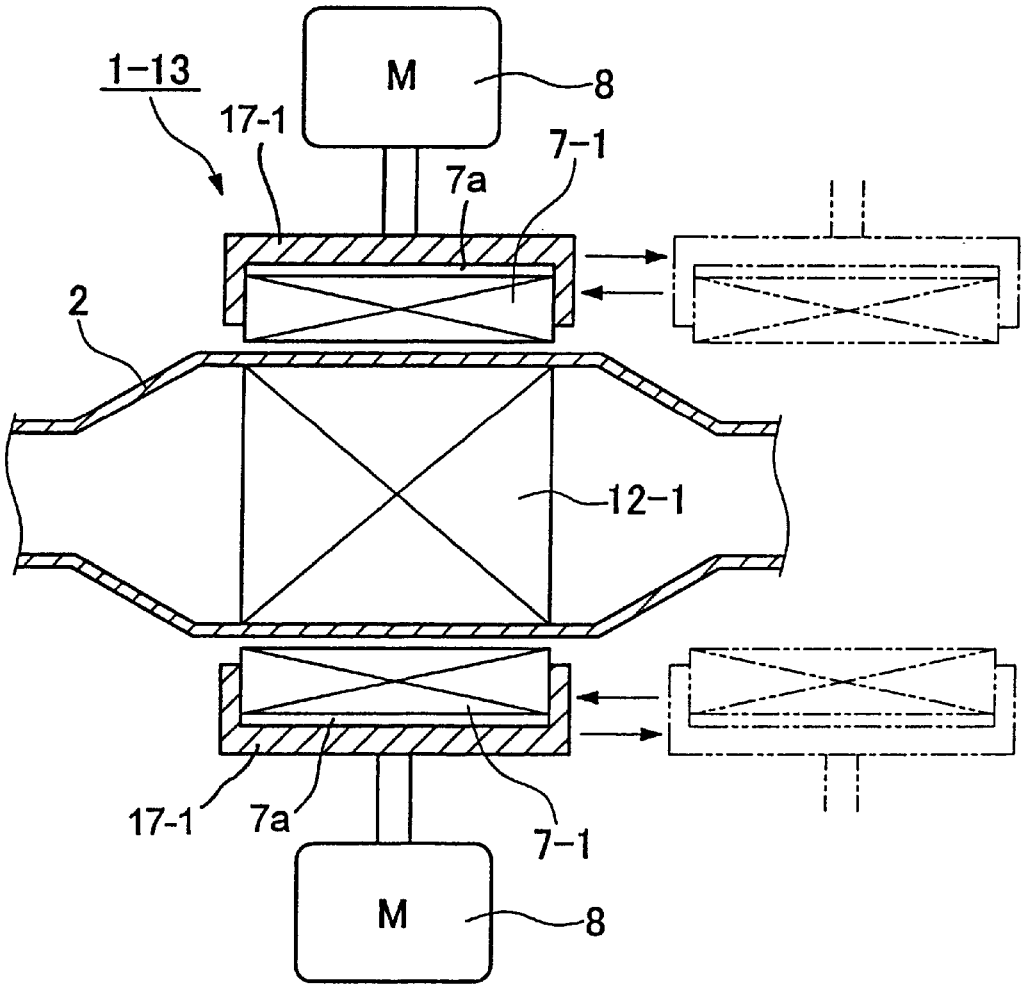
FIG. 15 is a vertically cut side view similarly showing a thirteenth embodiment.
Figure 16:
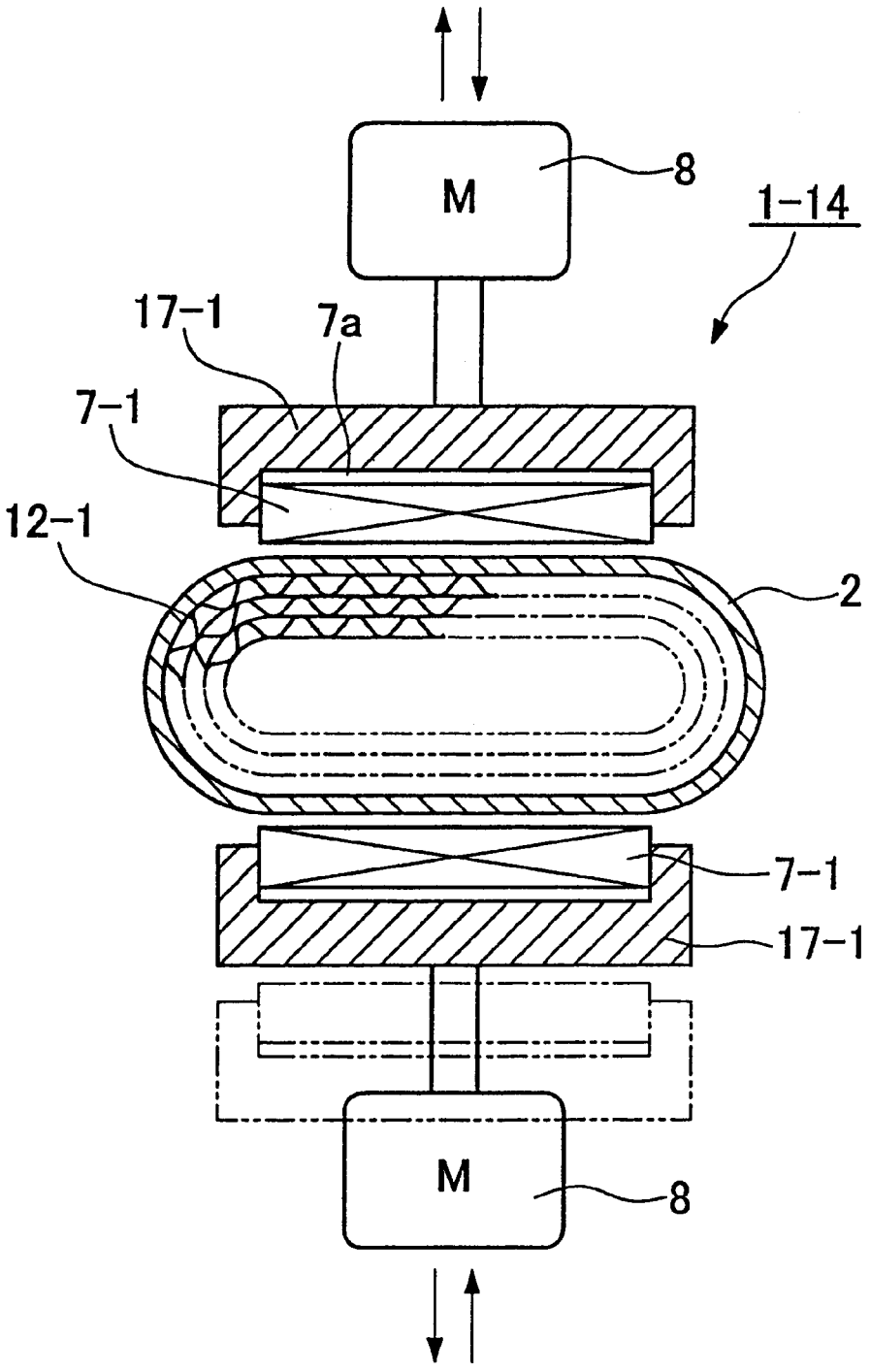
FIG. 16 is a vertically cut front view similarly showing a fourteenth embodiment.

The magnet type heaters 1-13 and 1-14 shown by FIG. 15 and FIG. 16 are applied to, for example, a catalyst device of emission gas of a diesel engine. The structure of the magnet type heater 1-13 shown by FIG. 15 is provided with a constitution similar to that of the magnet type heater 1-4 shown by FIG. 6. On the outer sides of the fluid pipe 2 made of a conductor, two of the permanent magnets 7-1 having the circular disk shape attached to the magnet supporters 17-1 via the yokes 7*a*, are arranged to be opposed to the pipe with very small gaps therebetween rotatably on the planes in parallel with the pipe shaft direction of the fluid pipe 2 made of a conductor on the center line in the radius direction of the pipe. Further, the pair of permanent magnets 7-1 in the circular disk shape are supported respectively rotatably by the drive motors 8 and rotated on the planes in parallel with the pipe shaft direction of the fluid pipe 2 made of a conductor by starting the respective drive motors 8. In addition to such a mechanism, the permanent magnets 7-1 in the circular disk shape can be slid respectively in the pipe shaft direction by, for example, a hydraulic pressure cylinder system. Further, the honeycomb core member 12-1 is incorporated in the fluid pipe 2 made of a conductor at a position opposed to the permanent magnet 7 and the honeycomb core member 12-1 carries a catalyst. Further, the permanent magnet 7-1 in the circular disk shape can be slid in the pipe shaft direction to prevent the permanent magnet from losing magnetic power by elevating its temperature at and above Curie point by slip heat generation as well as emission heat or reaction heat.

In the case of the magnetic type heater 1-13 shown by FIG. 15, when the respective drive motors 8 are started, the pair of permanent magnets 7-1 in the circular disk shape are respectively rotated on the planes in parallel with the pipe shaft direction of the fluid pipe 2 made of a conductor by which magnetic paths formed between the pair of permanent magnets 7-1 and the fluid pipe 2 made of a conductor are sheared to thereby generate slip heat generation in the fluid pipe 2 made of a conductor and by the generated heat of the fluid pipe 2 made of a conductor, the honeycomb core member 12-1 in the fluid pipe 2 is heated and the catalyst is activated. In this case, by the slip heat generation generated in the fluid pipe 2 made of a conductor, temperature of the honeycomb core member 12-1 can be elevated in a short period of time. Further, when the catalyst reaches high temperature, the permanent magnets 7-1 in the circular disk shape are made to escape in the pipe shaft direction and the permanent magnets are prevented from losing magnetic power by elevation of the temperature to or higher than Curie point. Meanwhile, when temperature of the catalyst becomes low, the permanent magnets 7-1 in the circular disk shape are again slid in a direction reverse to the above-described to thereby return to a predetermined position and operation similar to the above-described is carried out.

Further, although according to the magnet type heater 1-13 shown by FIG. 15, the permanent magnets 7-1 in the circular disk shape are slidable in the pipe shaft direction, the permanent magnets 7-1 in the circular disk shape may be slidable in a direction orthogonal to the pipe shaft.

Further, the structure of the magnet type heater 1-14 shown by FIG. 16 is provided with a constitution similar to that of the magnet type heater 1-5 shown by FIG. 7. In order to improve the energy efficiency by making constant distances between the permanent magnets 7-1 in the circular disk shape and pipe wall faces of the pipe 2, the section of the pipe arranged to be opposed to the permanent magnets 7-1 in the circular disk shape attached to the magnet supporters 17-1 via the yokes 7*a*, is formed in a flattened shape such as an oval shape or an elliptic shape. The pair of permanent magnets 7-1 in the circular disk shape are supported respectively rotatably by the drive motors 8 on the outer sides of the fluid pipe 2 made of a conductor in the flattened shape. Further, the permanent magnets 7-1 in the circular disk shape are made movable respectively in the pipe diameter direction by, for example, a hydraulic pressure cylinder system. Further, the honeycomb core member 12-1 is incorporated in the fluid pipe 2 made of a conductor at a position opposed to the permanent magnet 7 and a catalyst is carried by the honeycomb core member 12-1. Further, the permanent magnets 7-1 in the circular disk shape are made slidable in the pipe diameter direction to prevent the permanent magnets from losing magnetic power by elevating the temperature to or higher than Curie point by slip heat generation as well as emission heat or reaction heat similar to the above-described.

Also in the case of the magnet type heater 1-14 shown by FIG. 16, when the respective drive motors 8 are started, the pair of permanent magnets 7-1 in the circular disk shape are rotated respectively on the planes in parallel with the pipe shaft direction of the fluid pipe 2 made of a conductor by which magnetic paths formed between the pair of permanent magnets 7-1 and the fluid pipe 2 made of a conductor are sheared to thereby generate slip heat generation in the fluid pipe 2 made of a conductor and by the generated heat of the fluid pipe 2 made of a conductor, the honeycomb core member 12-1 in the fluid pipe 2 is heated and the catalyst is activated. In the case of the heater, stable magnetic paths are formed between the fluid pipe 2 made of a conductor in the flattened shape and the permanent magnets 7-1 in the circular disk shape by which slip heat generation is efficiently generated in the fluid pipe 2 made of a conductor in the flattened shape and accordingly, the temperature of the honeycomb core member 12-1 can be elevated to the temperature of activating the catalyst in a shorter period of time. When the catalyst reaches high temperature, the permanent magnets 7-1 in the circular disk shape are moved to escape in the outer direction of the pipe diameter and the permanent magnets are prevented from losing magnetic power by elevation of temperature to or higher than Curie point. Meanwhile, when the temperature of the catalyst becomes low, the permanent magnets 7-1 in the circular disk shape are moved in a direction opposed to the above-described to thereby return to a predetermined position and the operation similar to the above-described is carried out.

Figure 17:
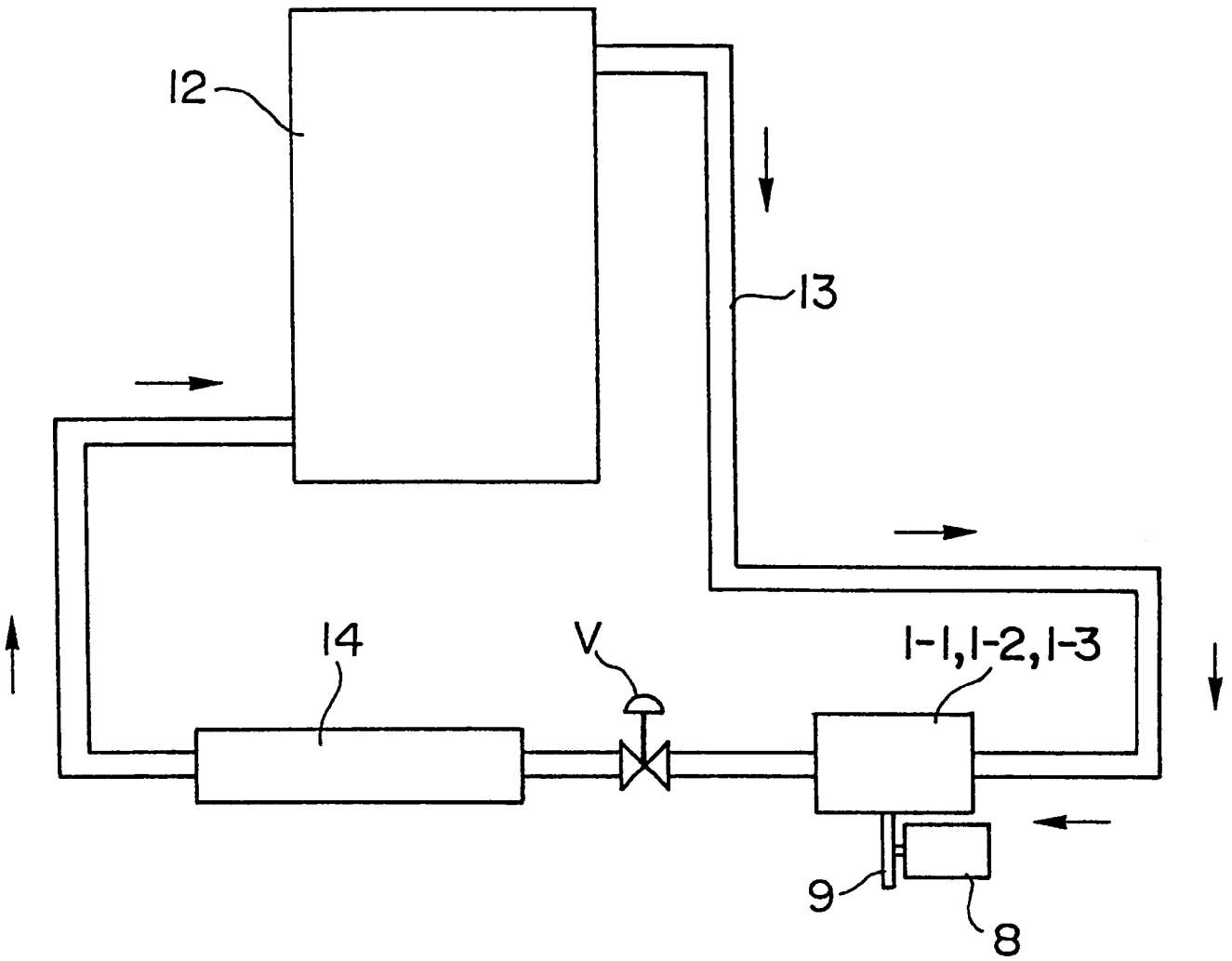
FIG. 17 is a system diagram showing an example of integrating a magnet type heater according to the invention to a heating apparatus of a vehicle.

FIG. 17 shows an example in which the magnet type heater according to the invention is integrated to a pipe constitution in which cooling water of the engine 13 passes through the cooling water pipe 14 and is circulated via the valve V and the heater core 15. The engine cooling water as a fluid in a pipe flowing in the cooling water pipe 14 is heated by being subjected to heat exchange by slip heat generation when the engine cooling water passes through the magnet type heater MH.

Figure 18:
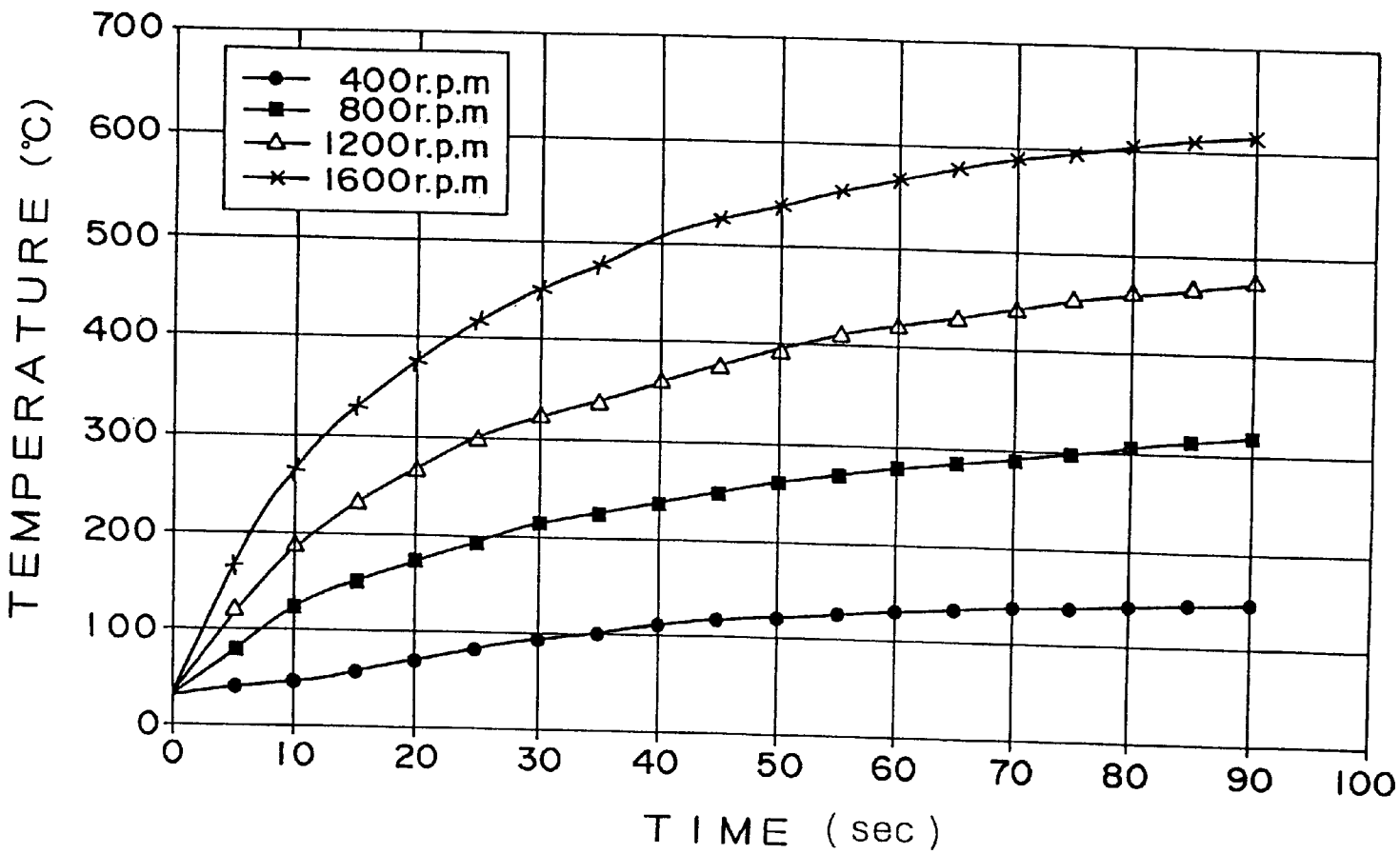
FIG. 18 is a diagram showing an example of heat generation data in the case of a combination of a rare earth magnet and an eddy current member which is carried out experimentally by the inventors.

FIG. 18 exemplifies heat generation data in the case of a combination of a rare earth magnet and an eddy current member which is experimentally carried out by the inventors. The data shows a relationship between time (sec) and temperature measured by arranging a permanent magnet and an eddy current member to be opposed to each other by setting a gap therebetween to 1.0 mm and variously changing a rotational number on the magnet side under a state in which the side of the eddy current member is fixed.

It is found from the data that by arranging the magnet and the conductor opposedly to each other with a very small gap therebetween and relatively rotating the magnet and the conductor, slip heat generation at 200 through 600° C. is generated in the conductor in several seconds through several tens seconds. Accordingly, when the conductor is attached to the side of the pipe of the engine cooling water, temperature of surface of heat exchange in respect with circulating water can be heated to high temperatures of 200 through 600° C. in an extremely short time period.

Further, as the fluid in the pipe, other than water, for example, liquid such as heat medium oil or silicone oil or a gas such as emission gas of a gasoline or a diesel engine, air, fuel gas of a fuel cell can naturally be adopted. Further, a number of installing the magnet type heaters is not limited to one but a necessary numbers thereof may be installed in accordance with the use.

As has been explained, the magnet type heater according to the invention utilizes slip heat generation generated in a conductor by relatively rotating a permanent magnet and a hysteresis member or a conductor comprising a hysteresis member installed with an eddy current member on a surface thereof on the side of the magnet. Therefore, in addition to effects in which the structure can further be simplified, the small size formation and the low cost formation can be realized and high reliability and safety can be ensured by a noncontact type mechanism having no wear, there is achieved an excellent effect in which, for example, in a case where rapid heating is needed when an engine is cold, by starting a drive motor, engine cooling water can rapidly be heated and the heating function of the engine can significantly be promoted. Accordingly, the invention achieves an excellent effect as an auxiliary heater capable of heating a fluid in a pipe to high temperatures in a shorter period of time and more efficiently and is extremely effective in a cold district specified vehicle mounted with a diesel engine.

Further, not only the temperature elevating characteristic can be promoted by a heat exchange core but also by carrying a catalyst at a heat exchange core in a honeycomb structure, the temperature of the catalyst can be elevated to temperature of activating the catalyst in a short period of time and accordingly, in comparison with a conventional method in which the catalyst is heated by the electric heater (EHC) to thereby purify emission gas, the purifying function of the catalyst in respect with NOx or the like is excellent and a significant effect is achieved also in reducing NOx, HC or the like in emission gas of a gasoline engine or a diesel engine.

Further, the invention achieves an excellent effect capable of being used also in elevating temperature of fuel gas such as hydrogen gas for a fuel cell.

What is claimed is:

1. A magnet type heater for heating a fluid in a pipe, said pipe having an outer surface of a selected outside diameter, said magnet type heater comprising:

a substantially cylindrical conductor having an inner surface with a diameter equal to the outer diameter of the pipe, the cylindrical conductor further having an outer surface, said inner surface of said conductor being fitted to the outer surface of the pipe, a substantially cylindrical housing rotatably supported on the pipe, the substantially cylindrical housing having an inner surface spaced outwardly from the outer surface of the cylindrical conductor, means for rotating the housing about the pipe, and a permanent magnet having a cylindrical shape with an inner surface and an opposed outer surface, said outer surface of said permanent magnet being fixed to the inner surface of the substantially cylindrical housing for rotation with the housing, the inner surface of the permanent magnet being concentric with the pipe and the conductor and being spaced from said outer surface of the said cylindrical conductor with a very small gap therebetween, whereby rotation of the housing and the permanent magnet relative to said conductor and said pipe causes fluid in the pipe to be heated by slip heat generation.

2. The magnet type heater of claim 1 wherein the conductor is a hysteresis member.

3. The magnet type heater of claim 2 wherein the hysteresis member is install with an eddy current member.

* * * * *